US005837411A

United States Patent [19]

Morishita et al.

[11] Patent Number: 5,837,411

[45] Date of Patent: Nov. 17, 1998

[54] PHTHALOCYANINE ELECTROPHOTOGRAPHIC PHOTORECEPTOR FOR CHARGE GENERATION LAYER

[75] Inventors: Yoshii Morishita; Megumi Matsui; Shigeru Hayashida, all of Hitachi; Takayuki Akimoto, Tsukuba; Mikio Itagaki, Hitachi, all of Japan

[73] Assignee: Hitachi Chemical Company, Ltd., Tokyo, Japan

[21] Appl. No.: 761,348

[22] Filed: Dec. 6, 1996

[30] Foreign Application Priority Data

Dec. 6, 1995 [JP] Japan ..... 7-317886

[51] Int. Cl.[6] ..... G03G 5/06

[52] U.S. Cl. ..... 430/59; 430/78

[58] Field of Search ..... 430/57, 58, 78, 430/76

[56] References Cited

U.S. PATENT DOCUMENTS

| | | | |
|---|---|---|---|
| 5,304,445 | 4/1994 | Itagaki et al. | 430/58 |
| 5,312,705 | 5/1994 | Tsuchiya et al. | 430/58 |
| 5,626,999 | 5/1997 | Itagaki et al. | 430/58 |

*Primary Examiner*—John Goodrow

*Attorney, Agent, or Firm*—Antonelli, Terry, Stout & Kraus, LLP

[57] ABSTRACT

Disclosed is a phthalocyanine composition which comprises having clear diffraction peaks at 17.9°, 24.0°, 26.2° and 27.2° of Bragg angles (2θ±0.2°) in an X-ray diffraction spectrum with Cu Kα, a process for preparing the same, an electrophotographic photoreceptor using the same and a coating solution for forming a charge generation layer containing the same.

13 Claims, 5 Drawing Sheets

PHTHALOCYANINE ELECTROPHOTOGRAPHIC PHOTORECEPTOR FOR CHARGE GENERATION LAYER

BACKGROUND OF THE INVENTION

This invention relates to a phthalocyanine composition, a process for preparing the same, an electrophotographic photoreceptor using the same and a coating solution for forming a charge generation layer containing the same.

As a conventional electrophotographic photoreceptor, there may be mentioned a photoreceptor in which about 50 μm of an selenium (Se) film is formed on a conductive substrate such as aluminum by a vacuum vapor deposition method. However, this Se photoreceptor has a problem that it has sensitivity only up to a wavelength of around 500 nm.

Also, there may be mentioned a photoreceptor in which about 50 m of a Se layer is formed on a conductive substrate, and several μm of a selenium-tellurium (Se-Te) alloy layer is further formed thereon. Whereas this photoreceptor has spectral sensitivity to a longer wavelength as the Te content of the above Se-Te alloy is higher, property of maintaining surface charge becomes worse as the amount of Te added is increased. Thus, there is a serious problem that it cannot be used practically as a photoreceptor.

Also, there may be mentioned the so-called composite two layer type photoreceptor in which a charge generation layer is formed on an aluminum substrate by coating about 1 μm of Chlorocyan Blue or a squaraine derivative, and a charge transport layer is formed thereon by coating 10 to 20 μm of a mixture of polyvinylcarbazole or a pyrazoline derivative and a polycarbonate resin having high insulation resistance. However, this photoreceptor does not have sensitivity to light of 700 nm or more as a matter of fact.

In recent years, there have been reported many composite two layer type photoreceptors in which the above drawbacks have been canceled, that is, those having sensitivity at around 800 nm which is the wavelength of a diode laser oscillation region. In many of these, a phthalocyanine pigment is used as a charge generating material, and on a charge generation layer having a film thickness of about 0.5 to 1 μm, a charge transport layer is formed by coating 10 to 20 μm of a mixture having high insulation resistance and comprising a polyvinylcarbazole, a pyrazoline derivative or a hydrazone derivative and a polycarbonate resin or a polyester resin to form a composite two layer type photoreceptor.

In phthalocyanines, not only absorption spectrum and photo-conductivity vary depending on central metals, but also these physical properties vary depending on crystal forms. There have been reported several examples of phthalocyanines in which the same central metal is used, but a specific crystal form is selected for an electrophotographic photoreceptor.

For example, there has been reported that various crystal forms exist in titanylphthalocyanines, and charging characteristics, dark decay and sensitivity vary greatly depending on the difference of their crystal forms.

In Japanese Provisional Patent Publication No. 49544/1984, it has been described that a crystal form of titanylphthalocyanine giving strong diffraction peaks at 9.2°, 13.1°, 20.7°, 26.2° and 27.1° of Bragg angles (2θ±0.2°) is preferred, and an X-ray diffraction spectrum chart is shown. Electrophotographic characteristics of a photo-receptor using the titanylphthalocyanine having the crystal form as a charge generating material are dark decay (DDR) of 85% and sensitivity ($E_{1/2}$) of 0.57 lux·sec.

Also, in Japanese Provisional Patent Publication No. 166959/1984, a charge generation layer is obtained by allowing a vapor deposited film of titanylphthalocyanine to stand in tetrahydrofuran-saturated vapor for 1 to 24 hours to change a crystal form.

It has been shown that the X-ray diffraction spectrum shows wide peaks and a smaller number of peaks and gives strong diffraction peaks at 7.5°, 12.6°, 13.0°, 25.4°, 26.2° and 28.6° of Bragg angles (2θ±0.2°).

Electrophotographic characteristics of a photoreceptor using the titanylphthalocyanine having the above crystal form as a charge generating material are dark decay (DDR) of 86% and sensitivity ($E_{1/2}$) of 0.7 lux·sec.

In Japanese Provisional Patent Publication No. 198452/1990, it has been described that a crystal form of titanylphthalocyanine having a main diffraction peak at 27.3° of Bragg angles (2θ±0.2°) has high sensitivity (1.7 mJ/m$^2$) and can be prepared by stirring in a mixed solution of water and o-dichlorobenzene under heating at 60° C. for one hour.

In Japanese Provisional Patent Publication No. 256059/1990, it has been described that a crystal form of titanylphthalocyanine having a main diffraction peak at 27.3° of Bragg angles (2θ±0.2°)has high sensitivity (0.62 lux·sec) and can be prepared by stirring in 1,2-dichloro-ethane at room temperature.

In Japanese Provisional Patent Publication No. 194257/1987, it has been described that two or more phthalocyanines are used and, for example, a mixture of titanylphthalocyanine and a non-metal phthalocyanine is used as a charge generating material.

Thus, the phthalocyanines are greatly different in electrophotographic characteristics depending on the difference of crystal forms and the crystal form is an important factor for deciding characteristics of an electrophotographic photoreceptor. Particularly, titanylphthalocyanine provides a charge generating material having extremely high sensitivity and excellent characteristics by changing a crystal form.

However, in a laser beam printer for which it is used, higher quality and higher resolution have been achieved, and an electrophotographic photoreceptor having further high sensitivity characteristic has been demanded.

Therefore, in Japanese Provisional Patent Publication No. 175382/1994, there have been proposed a novel phthalocyanine composition having main diffraction peaks at 7.5°, 22.5°, 24.3°, 25.3° and 28.6° of Bragg angles (2θ±0.2°) in an X-ray diffraction spectrum with Cu Kα, and a process for preparing the same, which comprises precipitating a phthalocyanine mixture containing titanylphthalocyanine and a halogenated metal phthalocyanine in which a central metal is trivalent in water by an acid pasting method and then treating the resulting precipitates with an organic solvent.

This phthalocyanine composition provides a charge generating material having high sensitivity and excellent characteristics by changing a crystal form. However, in a laser printer for which it is used, higher quality and higher resolution have been achieved, and an electrophotographic photoreceptor having further high sensitivity characteristic has been demanded.

In Japanese Provisional Patent Publication No. 271786/1994, there have been proposed a phthalocyanine composition having main diffraction peaks at 7.5°, 24.2° and 27.3° of Bragg angles (2θ±0.2°) in an X-ray diffraction spectrum with Cu Kα, and a process for preparing the same. The composition exhibits further high sensitivity characteristic.

According to this process, the above phthalocyanine composition can be prepared simply and easily. However, when the composition is used as a charge generating material of an electrophotographic photoreceptor, there is a problem that electrophotographic characteristics of the electrophotographic photoreceptor are fluctuated delicately depending on the difference in production lot of the phthalocyanine composition. Further, when the electrophotographic photoreceptor is loaded in a laser printer and continuous printing is carried out, there is a problem that electrophotographic characteristics thereof, particularly a dark decay rate, are greatly lowered to worsen printing quality. For this reason, it has been desired to establish a phthalocyanine composition exhibiting excellent characteristics and stability, and preparation conditions under which the phthalocyanine composition can be prepared stably.

SUMMARY OF THE INVENTION

The invention according to claim 1 is to provide a phthalocyanine composition which has high sensitivity and is free from deterioration of characteristics at the time of repeated use.

The invention according to claim 6 is to provide a process for preparing a phthalocyanine composition which has high sensitivity and is free from deterioration of characteristics at the time of repeated use.

The invention according to claim 12 is to provide an electrophotographic photoreceptor which has high sensitivity and is free from deterioration of characteristics at the time of repeated use.

The invention according to claim 13 is to provide a composite structure electrophotographic photoreceptor which has high sensitivity and a high dark decay rate, and is free from deterioration of characteristics and exhibits good image characteristics at the time of repeated use.

The invention according to claim 16 is to provide a composite structure electrophotographic photoreceptor which has high sensitivity and low residual potential, and is free from deterioration of characteristics and exhibits good image characteristics at the time of repeated use.

The invention according to claim 19 is to provide a coating solution for forming a charge generation layer to be used in an electrophotographic photoreceptor which has high sensitivity and is free from deterioration of characteristics at the time of repeated use.

The present invention relates to a phthalocyanine composition which comprises having clear diffraction peaks at 17.9°, 24.0°, 26.2° and 27.2° of Bragg angles (2θ±0.2°) in an X-ray diffraction spectrum with Cu Kα.

Also, the present invention relates to a process for preparing a phthalocyanine composition having clear diffraction peaks at 17.9°, 24.0°, 26.2° and 27.2° of Bragg angles (2θ±0.2°) in an X-ray diffraction spectrum with Cu Kα, which comprises (1) precipitating a phthalocyanine mixture containing
  (a) titanylphthalocyanine and
  (b) a halogenated metal phthalocyanine in which a central metal is trivalent in water by an acid pasting method to obtain precipitates having a characteristic diffraction peak at 27.2° of Bragg angles (2θ±0.2°) in an X-ray diffraction spectrum with Cu Kα and subsequently (2) treating the precipitates in a mixed solvent of an aromatic organic solvent and water.

Further, the present invention relates to an electrophotographic photoreceptor having a photoconductive layer containing an organic photoconductive substance on a conductive substrate, in which the organic photoconductive substance is the above phthalocyanine composition.

Further, the present invention relates to a composite sturcture double-layered type electrophotographic photoreceptor having (A) a charge generation layer containing the above phthalocyanine composition as a charge generation substance and (B) a charge transport layer containing a benzidine derivative represented by the formula (I):

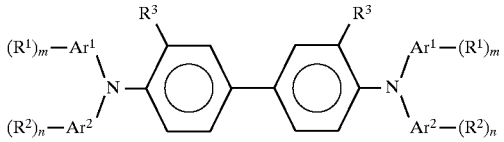

(I)

wherein $R^1$ and $R^2$ each independently represent a hydrogen atom, a halogen atom, an alkyl group, an alkoxy group, an aryl group, a fluoroalkyl group or a fluoroalkoxy group, two $R^3$s each independently represent a hydrogen atom or an alkyl group, $Ar^1$ and $Ar^2$ each independently represent an aryl group, and m and n each independently represent an integer 0 to 5, as a charge transport substance.

Further, the present invention relates to a composite structure double-layered type electrophotographic photoreceptor having (A) a charge generation layer containing the above phthalocyanine composition as a charge generation substance and (C) a charge transport layer containing a butadiene derivative represented by the formula (II):

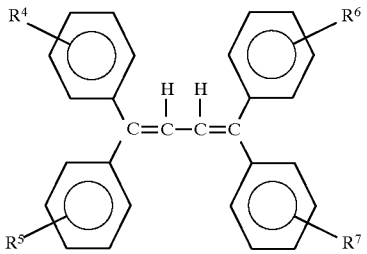

(II)

wherein $R^4$, $R^5$, $R^6$ and $R^7$ each independently represent a hydrogen atom, a halogen atom, an alkyl group, an alkoxy group, a di-lower alkylamino group, a diarylamino group or a diaralkylamino group, as a charge transport substance.

Further, the present invention relates to a coating solution for forming a charge generation layer containing the above phthalocyanine composition.

Generally speaking, a phthalocyanine mixture is a mere physical mixture of two or more phthalocyanines used as starting materials and an X-ray diffraction pattern of the phthalocyanine mixture comprises piled up (sum) peak patterns of respective phthalocyanines used as starting materials.

On the other hand, the phthalocyanine composition of the present invention is a mixed crystal of phthalocyanines used as starting materials in a molecular order and an X-ray diffraction pattern thereof is different from that of a pattern in which peak patterns of the respective phthalocyanines used as starting materials are piled up.

The term "clear diffraction peak" mentioned in the present specification means a peak which can be easily recognizable as a peak in an X-ray diffraction pattern.

The term "mixed crystal" mentioned in the present specification means not a mere physical mixture but a crystal material comprising different kinds of phthalocyanines.

DESCRIPTION OF THE PREFERRED EMBODIMENTS

Figure 1:
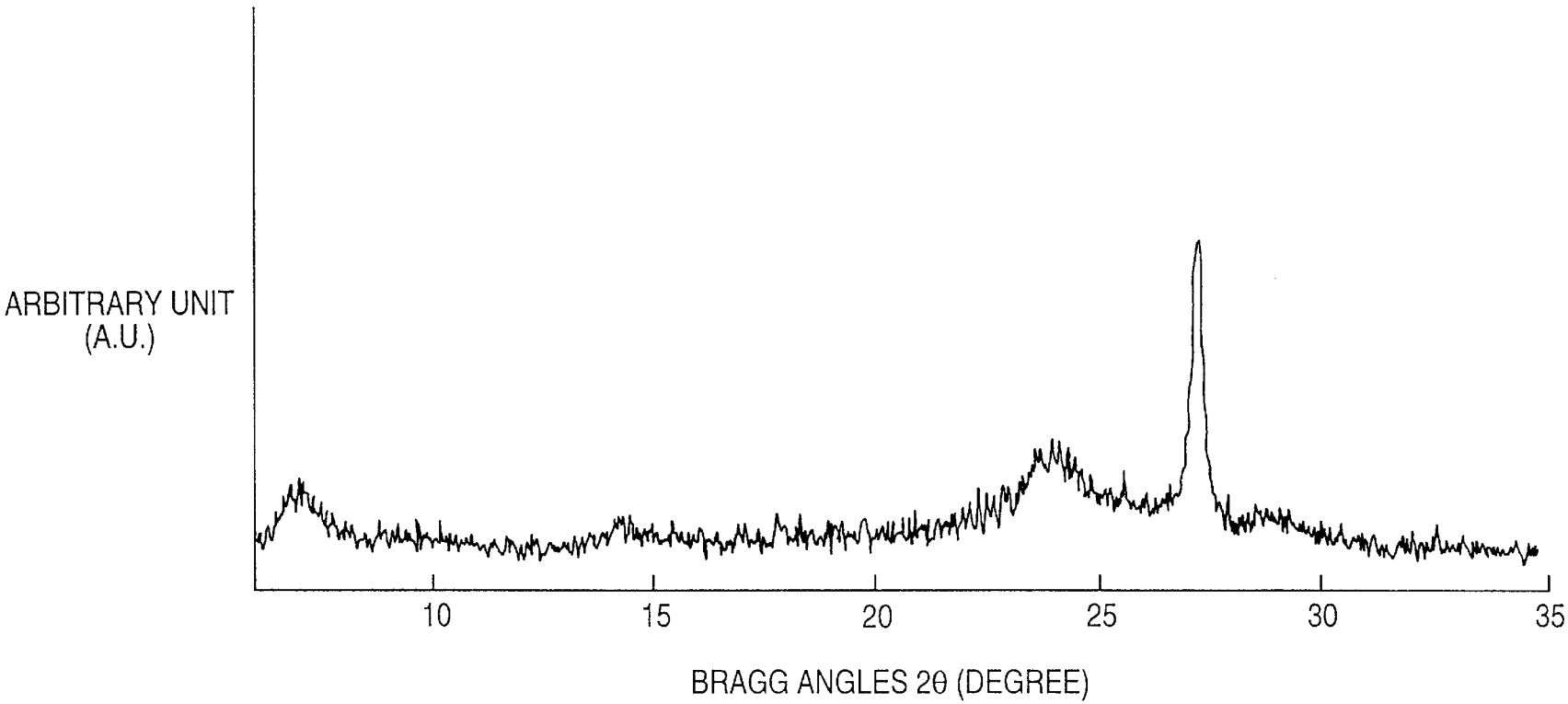
FIG. 1 is an X-ray diffraction spectrum of a dried product obtained in Example 1.

In the following, the present invention is explained in detail.

The phthalocyanine composition of the present invention is a phthalocyanine composition having clear diffraction peaks at 17.9°, 24.0°, 26.2° and 27.2° of Bragg angles (2θ±0.2°) in an X-ray diffraction spectrum with Cu Kα.

The phthalocyanine composition of the present invention is prepared by precipitating a phthalocyanine mixture containing (a) titanylphthalocyanine and (b) a halogenated metal phthalocyanine in which a central metal is trivalent in water by an acid pasting method to obtain precipitates having a characteristic diffraction peak at 27.2° of Bragg angles (2θ±0.2°) in an X-ray diffraction spectrum with Cu Kα and subsequently treating the precipitates in a mixed solvent of an aromatic organic solvent and water.

The titanylphthalocyanine (a) used in the present invention is not particularly limited. Known titanylphthalocyanines can be used, and titanylphthalocyanine prepared as described below can be also used.

To 120 ml of α-chloronaphthalene is added 18.4 g (0.144 mole) of phthalonitrile, and then 4 ml (0.0364 mole) of titanium tetrachloride is dropped to the mixture under nitrogen atmosphere.

After the dropping, the mixture is heated and reacted at 200° to 220° C. for 3 hours under stirring, and then the reaction mixture is filtered while heating at 100° to 130° C. and the residue is washed with α-chloronaphthalene and then with methanol.

The residue is hydrolyzed (at 90° C. for one hour) with 140 ml of a deionized water, and this operation is repeated until the solution becomes neutral. The residue is then washed with methanol. Subsequently, the residue is sufficiently washed with N-methylpyrrolidone of 100° C. and then washed with methanol.

The compound thus obtained is dried by heating at 60° C. under vacuum to obtain desired titanylphthalocyanine (yield: 46%).

In the halogenated metal phthalocyanine compounds (b) in which a central metal is trivalent in the present invention, a trivalent metal as a central metal includes, for example, In, Ga and Al, and a halogen includes, for example, Cl and Br. Said compounds may have a substituent(s) such as a halogen on a phthalocyanine ring.

These compounds are known compounds, and, for example, synthetic methods of monohalogenated metal phthalocyanine and monohalogenated metal halogen phthalocyanine are described in Inorganic Chemistry, 19, 3131 (1980) and Japanese Provisional Patent Publication No. 44054/1984.

The monohalogenated metal phthalocyanine can be prepared by, for example, the following manner.

To 100 ml of quinoline purified by carrying out distillation twice are added 78.2 mmole of phthalonitrile and 15.8 mmole of metal trihalide, and the mixture is refluxed under heating for 0.5 to 3 hours. Subsequently, the mixture is cooled to room temperature and then filtered. The crystal is washed with toluene, acetone and then methanol, further washed with methanol by using a Soxhlet extractor and then dried by heating at 60° C. under vacuum to obtain the monohalogenated metal phthalocyanine.

Further, the monohalogenated metal halogen phthalocyanine can be prepared by, for example, the following manner.

After 156 mmole of phthalonitrile and 37.5 mmole of metal trihalide are mixed and melted at 300° C., the mixture is heated for 0.5 to 3 hours to obtain a crude product of monohalogen metal halogen phthalocyanine. The product is washed with α-chloronaphthalene by using a Soxhlet's extractor to obtain the monohalogenated metal halogen phthalocyanine.

As to a formulation ratio of the phthalocyanine mixture containing the titanylphthalocyanine (a) and the halogenated metal phthalocyanine (b) in which a central metal is trivalent in the present invention, the formulation amount of the titanylphthalocyanine (a) is preferably 20 to 95 parts by weight, more preferably 50 to 90 parts by weight, particularly preferably 65 to 90 parts by weight, extremely preferably 75 to 90 parts by weight based on the total amount of Component (a) and Component (b) being 100 parts by weight, from the point of electrophotographic characteristics such as charging characteristics, dark decay and sensitivity.

The phthalocyanine mixture containing the above Component (a) and Component (b) in the present invention can be made amorphous by precipitating it in water by the acid pasting method.

For example, 1 g of the phthalocyanine mixture is dissolved in 50 ml of conc. sulfuric acid, and the mixture is stirred at room temperature. Subsequently, the mixture is dropped to 1 liter of a deionized water cooled with ice water over about one hour, preferably 40 minutes to 50 minutes, and then the resulting precipitates are recovered by filtration.

Subsequently, the precipitates are washed with a deionized water, and the precipitates are washed repeatedly until a washing water after washing has a pH of 2 to 5, preferably a pH of about 3 and a conductivity of 5 to 500 μS/cm. Then, the precipitates are washed sufficiently with methanol and dried by heating at 60° C. under vacuum to obtain powder (or mixed crystal) of a phthalocyanine composition.

The powder of the precipitates (or mixed crystal) comprising the above Component (a) and Component (b) formed as described above gives a clear diffraction peak at 27.2° of Bragg angles (2θ±0.2°) in an X-ray diffraction spectrum with Cu Kα, but other peaks are wide so that their values cannot be determined specifically.

If the pH of the above washing water after washing exceeds 5, characteristic peak strength at 27.2° of Bragg angles (2θ±0.2°) in an X-ray diffraction spectrum with Cu Kα is lowered and a new peak stronger in intensity than the peak at 27.2° is formed at 6.8°. If a crystal form of such powder is changed by using a mixed solvent of an aromatic organic solvent and water, there is a tendency that the phthalocyanine composition of the present invention cannot be obtained. If the pH of the washing water after washing is less than 2 or exceeds 5, charging characteristics, dark decay and sensitivity tend to be poor.

If the conductivity of the washing water after washing is less than 5 μS/cm or exceeds 500 μS/cm, charging characteristics, dark decay and sensitivity tend to be poor.

Then, the crystal form of the powder of the precipitates obtained above is changed by treating it in a mixed solvent of an aromatic organic solvent and water to obtain the phthalocyanine composition of the present invention having clear diffraction peaks at 17.9°, 24.0°, 26.2° and 27.2° of Bragg angles (2θ±0.2°) in an X-ray diffraction spectrum with Cu Kα.

As the aromatic organic solvent to be used in the present invention, there may be mentioned, for example, benzene, toluene, xylene and o-dichlorobenzene, and among them, toluene and xylene are preferred.

A weight ratio of the aromatic organic solvent to water to be used in the present invention is preferably 1/99 to 99/1, more preferably 95/5 to 5/95 from the point of changing efficiency of the crystal form.

A ratio of the precipitates (phthalocyanine which is made amorphous) is preferably 1 to 5 parts by weight based on the total amount of the aromatic organic solvent and water being 100 parts by weight.

The treatment in a mixed solvent of an aromatic organic solvent and water in the present invention can be carried out by, for example, contacting a mixed solvent of an aromatic organic solvent and water of 40° C. to 100° C. with the precipitates for one hour or longer.

As a contacting method, there may be used a means of carrying out pulverization and stirring under heating simultaneously, by which stable electrophotographic characteristics can be obtained when the composition is used as a charge generating material of an electrophotographic photoreceptor.

As the means of carrying out pulverization and stirring under heating simultaneously, there may be mentioned heat milling treatment, homogenizing and paint shaking, and among them, heat milling treatment with zirconia beads and a stirring rate of 100 to 300 rpm is preferred from the point that more stable electrophotographic characteristics can be obtained.

As a medium to be used for pulverization treatment such as heat milling treatment, for example, zirconia beads are preferred. The size of the beads is preferably a diameter (ϕ) of 0.2 to 3 mm, more preferably 0.5 to 2 mm, particularly preferably 0.8 to 1.5 mm.

The heating temperature is preferably 40° to 100° C., more preferably 60° to 100° C., particularly preferably 60° to 80° C.

The electrophotographic photoreceptor according to the present invention has a photoconductive layer containing the phthalocyanine composition of the present invention as an organic photoconductive substance, provided on a conductive substrate.

As the conductive substrate in the present invention, there may be mentioned, for example, a plate of a metal (e.g., aluminum, an aluminum alloy, steel, iron and copper), a plate of a metal compound (e.g., tin oxide, indium oxide and chromium oxide) or a substrate obtained by covering plastic with a conductive particle (e.g., carbon black and a silver particle) together with a suitable binder, and a material obtained by imparting conductivity to plastic, paper or glass by vapor deposition, sputtering or the like.

As the shape of the above substrate, there may be mentioned a cylindrical shape and a sheet, but the shape, size and surface roughness of the substrate are not particularly limited.

The photoconductive layer in the present invention is a layer containing an organic photoconductive substance, including, for example, a film of an organic photoconductive substance, a film containing an organic photoconductive substance and a binder, and a double-layered type film comprising a charge generation layer and a charge transport layer.

As the organic photoconductive substance in the present invention, the above phthalocyanine composition of the present invention is used as an indispensable component, and further known pigments may be used in combination.

Further, as the organic photoconductive substance of the present invention, the phthalocyanine composition of the present invention is preferably used in combination with a charge generation substance (an organic pigment which generates a charge) and/or a charge transport substance. The above charge generation layer contains the phthalocyanine composition of the present invention and/or a charge generation substance (an organic pigment which generates a charge), and the charge transport layer contains a charge transport substance.

As the charge generation substance (an organic pigment which generates a charge), there may be used pigments which have been known to generate a charge, such as metallic or non-metallic type phthalocyanines having various crystalline structures, for example, α type, β type, γ type, δ type, ϵ type and χ type. The above charge generation substance may include azo pigments, anthraquinone pigments, indigoid pigments, quinacridone pigments, perillene pigments, polycyclic quinone pigments and methine pigments.

These pigments have been disclosed in, for example, Japanese Provisional Patent Publications No. 37543/1972, No. 37544/1972, No. 18543/1972, No. 18544/1972, No. 43942/1973, No. 70538/1973, No. 1231/1974, No. 105536/1974, No. 75214/1975, No. 44028/1978 and No. 17732/1979.

Further, τ, τ', η and η' type non-metallic phthalocyanines as disclosed in Japanese Provisional Patent Publication No. 182640/1983 and European Patent Publication No. 92,255 may be used. In addition to those described above, any organic pigment which generates a charge by irradiation of light may be used.

As the charge transport substance, there may be mentioned a polymeric compound such as poly-N-vinylcarbazole, halogenated poly-N-vinylcarbazole, polyvinyl pyrene, polyvinyl indoloquinoxaline, polyvinyl benzothiophene, polyvinyl anthracene, polyvinyl acridine and polyvinyl pyrazoline, and a monomeric compound such as fluorenone, fluorene, 2,7-dinitro-9-fluorenone, 4H-indeno (1,2,6)thiophen-4-one, 3,7-dinitro-dibenzothiophene-5-oxide, 1-bromopyrene, 2-phenyl-pyrene, carbazole, N-ethylcarbazole, 3-phenylcarbazole, 3-(N-methyl-N-phenylhydrazone)methyl-9-ethylcarbazole, 2-phenylindole, 2-phenylnaphthalene, oxadiazole, 2,5-bis(4-diethylaminophenyl)-1,3,4-oxadiazole, 1-phenyl-3-(4-diethylaminostyryl)-5-(4-diethylaminostyryl)-5-(4 -diethylaminophenyl)pyrazoline, 1-phenyl-3-(p-diethylaminophenyl)-pyrazoline, p-(dimethylamino)-stilbene, 2-(4-dipropylamino-phenyl)-4-(4-dimethylaminophenyl)-5-(2-chlorophenyl)-1,3-oxazole, 2-(4-dimethylaminophenyl)-4-(4-dimethylamino-phenyl)-5-(2-fluorophenyl)-1,3-oxazole, 2-(4-diethylamino-phenyl)-4-(4-dimethylaminophenyl)-5-(2-fluorophenyl)-1,3-oxazole, 2-(4-dipropylaminophenyl)-4-(4-dimethylamino-phenyl)-5-(2-fluorophenyl)-1,3-oxazole, imidazole, chrysene, tetraphene, acridene, triphenylamine and derivatives thereof, and 4-N',N'-diphenylaminobenzaldehyde-N,N-diphenylhydrazone, 4-N',N'-ditolylaminobenzaldehyde-N,N-diphenylhydrazone, N,N,N',N'-tetraphenylbenzidine, N,N'-diphenyl-N,N'-bis(3-methylphenyl)-benzidine, N,N,N',N'-tetrakis(4-methylphenyl)-benzidine, N,N'-diphenyl-N,N'-bis(4-methoxyphenyl)-benzidine, N,N,N',N'-tetrakis (4-methylphenyl)-tolidine, 1,1-bis(4-diethylaminophenyl)-4,4-diphenyl-1,3-butadiene and derivatives thereof.

Among the charge transport substances described above, benzidine derivatives and butadiene derivatives are preferred. Among them, more preferred are the benzidine derivative represented by the formula (I):

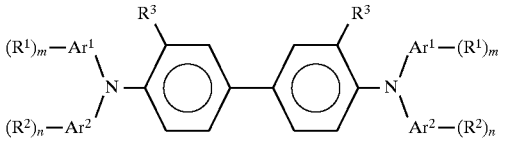

(I)

wherein $R^1$ and $R^2$ each independently represent a hydrogen atom, a halogen atom, an alkyl group, an alkoxy group, an aryl group, a fluoroalkyl group or a fluoroalkoxy group, two $R^3$s each independently represent a hydrogen atom or an alkyl group, $Ar^1$ and $Ar^2$ each independently represent an aryl group, and m and n each independently represent an integer 0 to 5, and the butadiene derivative represented by the formula

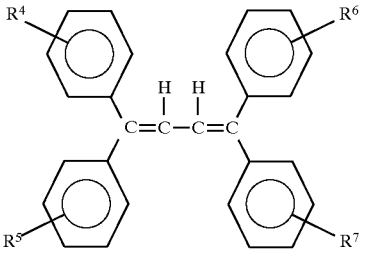

(II)

wherein $R^4$, $R^5$, $R^6$ and $R^7$ each independently represent a hydrogen atom, a halogen atom, an alkyl group, an alkoxy group, a di-lower alkylamino group, a diarylamino group or a diaralkylamino group.

In the above formula (I), the alkyl group may include those having 1 to 6 carbon atoms, preferably 1 to 4 carbon atoms, for example, a methyl group, an ethyl group, an n-propyl group, an isopropyl group, an n-butyl group and a tertbutyl group. The alkoxy group may include those having 1 to 6 carbon atoms, preferably 1 to 3 carbon atoms, for example, a methoxy group, an ethoxy group, an n-propoxy group and an isopropoxy group. The aryl group may include, for example, a phenyl group, a tolyl group, a biphenyl group, a terphenyl group and a naphthyl group. The fluoroalkyl group may include those having 1 to 6 carbon atoms, preferably 1 to 3 carbon atoms, for example, a trifluoromethyl group, a trifluoroethyl group and a heptafluoropropyl group. The fluoroalkoxy group may include those having 1 to 6 carbon atoms, preferably 1 to 4 carbon atoms, for example, a trifluoromethoxy group, a 2,2-difluoroethoxy group, a 2,2,2-trifluoroethoxy group, a 1H,1H-pentafluoropropoxy group, a hexafluoro-iso-propoxy group, a 1H,1H-pentafluorobutoxy group, a 2,2,3,4,4,4-hexafluorobutoxy group and a 4,4,4-trifluorobutoxy group Specific examples of the benzidine derivative represented by the above formula (I) may include Compounds No. 1 to No. 10 shown below.

No. 1

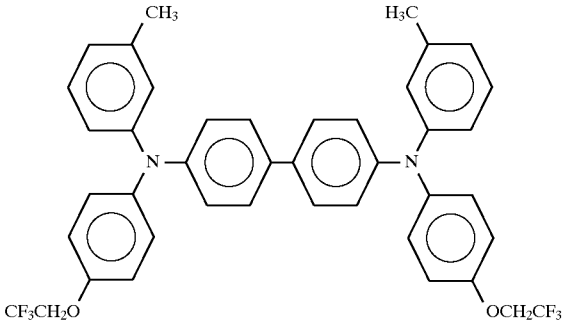

-continued

No. 2

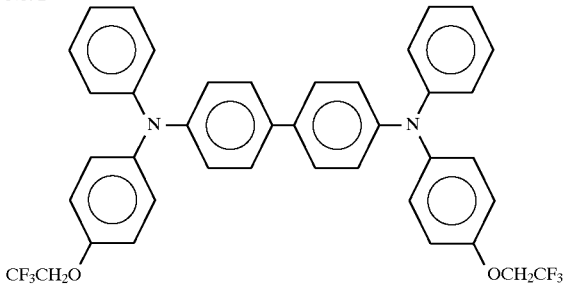

No. 3

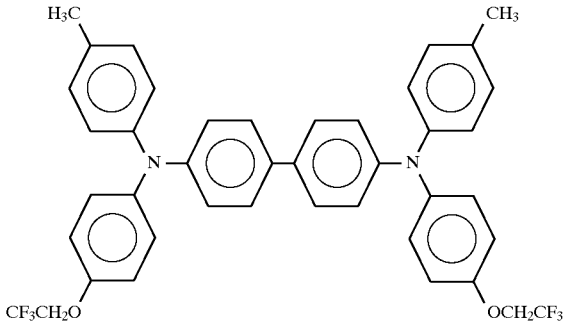

No. 4

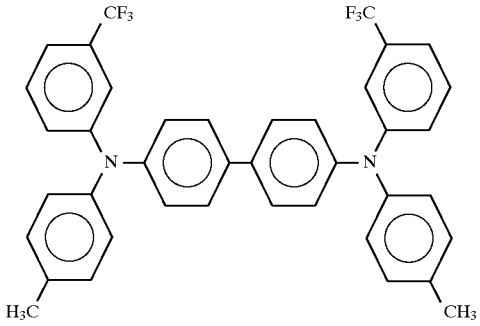

No. 5

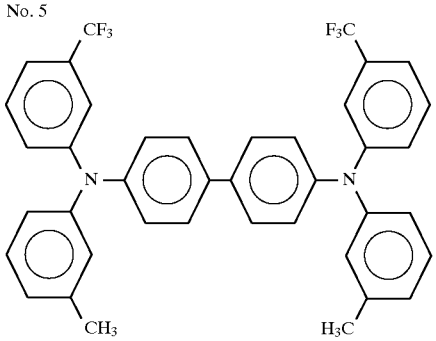

No. 6

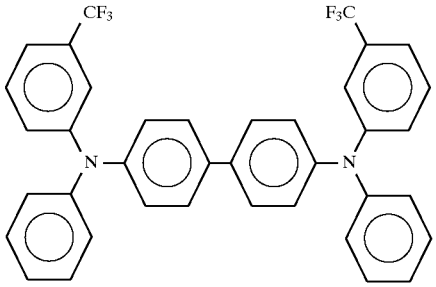

-continued

No. 7

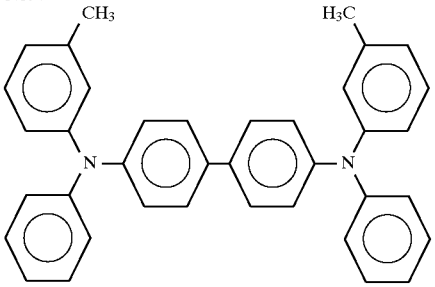

No. 8

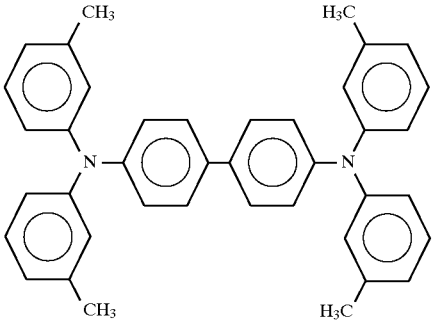

No. 9

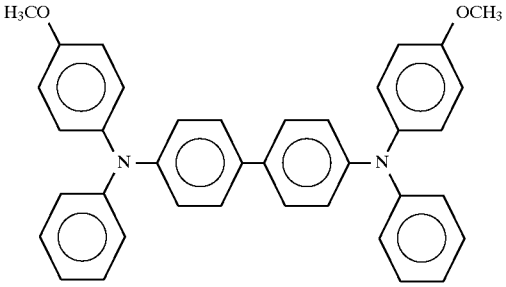

No. 10

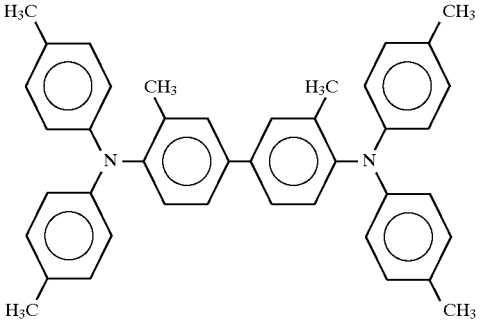

In the above formula (II), the halogen atom may include, for example, chlorine and bromine. The alkyl group may include an alkyl group having 1 to 6 carbon atoms, preferably 1 to 4 carbon atoms, for example, a methyl group, an ethyl group and a n-propyl group. The alkoxy group may include an alkoxy group having 1 to 6 carbon atoms, preferably 1 to 4 carbon atoms, for example, a methoxy group, an ethoxy group and a n-propoxy group. The di-lower alkylamino group may include an alkylamino group each having 1 to 6 alkyl carbon atoms, preferably 1 to 3 carbon atoms, for example, a dimethylamino group and a diethylamino group. The diarylamino group may include a diarylamino group substituted by an aryl group such as a phenyl group, a tolyl group, a xylyl group, a naphthyl group, and, for example, a diphenylamino group and a ditolylamino group. The diaralkylamino group may include a diaralkyl group substituted by an aralkyl group such as a benzyl group, a phenethyl group, and, for example, a dibenzylamino group.

Specific examples of the butadiene derivative represented by the above formula (II) may include Compounds No. 11 to No. 16 shown below.

No. 11

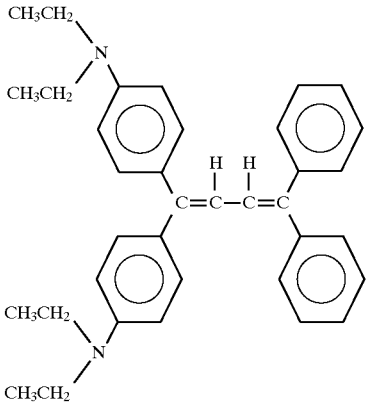

No. 12

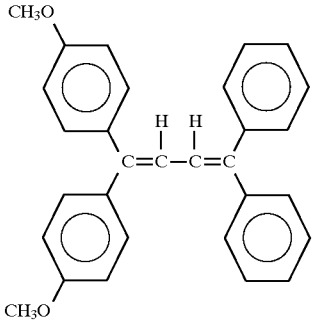

No. 13

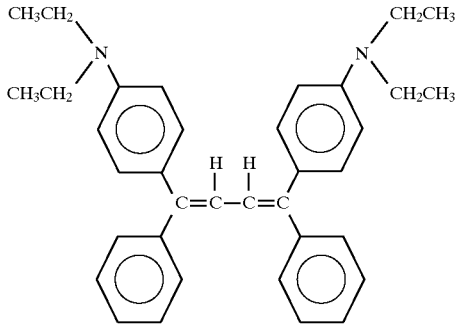

-continued

No. 14

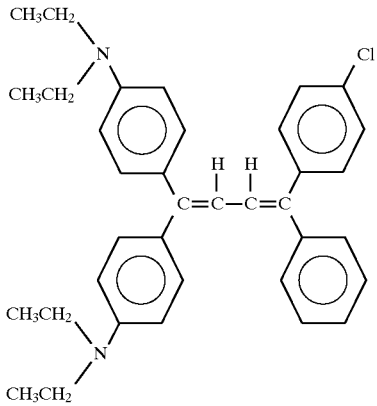

No. 15

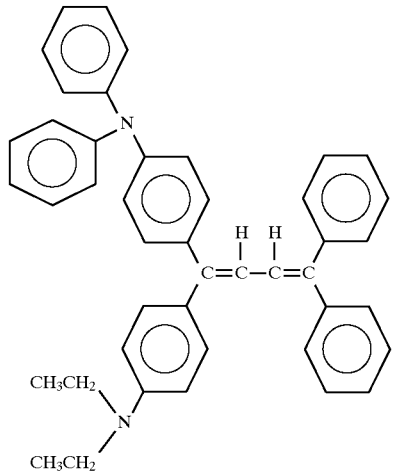

No. 16

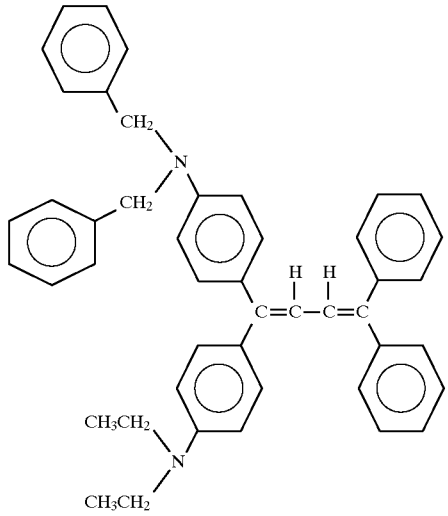

As to the organic photoconductive substance to be contained in the photoconductive layer in the present invention, when a mixture of the above phthalocyanine composition of the present invention and, if necessary, the charge generation substance (an organic pigment which generates a charge) (these are called the former), and the charge transport substance (this is called the latter) is used (when a single layer type photoconductive layer is to be formed), a weight ratio of the latter/the former to be formulated is preferably within the range of 10/1 to 2/1.

In addition to the above organic photoconductive substance, it is preferred to formulate a binder into the photoconductive layer in the present invention.

The binder is not particularly limited so long as it is a resin which has insulation property and can form a film under normal conditions, and a resin which is cured by heat and/or light to form a film. As the binder, there may be mentioned, for example, a silicone resin, a polyamide resin, a polyurethane resin, a polyester resin, an epoxy resin, a polyketone resin, a polycarbonate resin, a polycarbonate copolymer, a polyester carbonate resin, a polyformal resin, poly(2,6-dimethylphenylene oxide), a polyvinyl butyral resin, a polyvinyl acetal resin, a styreneacrylate type copolymer, a polyacrylic resin, a polystyrene resin, a melamine resin, a styrene-butadiene copolymer, a poly(methyl methacrylate) resin, a polyvinyl chloride, an ethylene-vinyl acetate copolymer, a vinyl chloride-vinyl acetate copolymer, a polyacrylamide resin, a polyvinylcarbazole, a polyvinyl pyrazoline and a polyvinyl pyrene. Further, a thermosetting resin and a photocuring resin which are crosslinked by heat and/or light may be also used. These binders are used singly or in combination of two or more.

When the binder is to be formulated, the amount to be formulated is preferably 0 to 500 parts by weight, more preferably 30 to 500 parts by weight based on the total amount of the above phthalocyanine composition of the present invention and, if necessary, the charge generation substance and the charge transport substance being 100 parts by weight.

When the above binder is used in the photoconductive layer of the present invention, an additive such as a plasticizer, a flowability imparting agent, a pinhole preventing agent, an antioxidant and a UV absorbent may be added, if necessary.

The plasticizer may include, for example, biphenyl, 3,3'-4,4'-tetramethyl-1,1'-biphenyl, 3,3",4,4"-tetramethyl-p-terphenyl, 3,3",4,4"-tetramethyl-m-terphenyl, halogenated paraffin, dimethylnaphthalene and dibutylphthalate.

The flowability imparting agent may include, for example, Modaflow (trade name, produced by Monsant Chemical Co.) and Akulonal 4F (trade name, produced by BASF Co.).

The pinhole preventing agent may include, for example, benzoin and dimethylphthalate.

The antioxidant and the UV absorbent may include, for example, 2,6-di-t-butyl-4-methylphenol, 2,4-bis(n-octylthio)-6-(4-hydroxy-3,5-di-t-butylanilino)-1,3,5-triazine, 1,3,5-trimethyl-2,4,6-tris(3,5-di-t-butyl-4-hydroxybenzyl)-benzene, 2-(5-t-butyl-2-hydroxyphenyl) benzotriazole, 2-[2-hydroxy-3,5-bis(α,α-dimethylbenzyl) phenyl]-2H benzotriazole and Antigen FR (trade name, produced by Ouchi Shinko Kagaku Co.).

These additives may be suitably selected and used, and the amounts thereof may be also suitably determined.

When the photoconductive layer in the present invention forms a composite double-layered structure photoconductive layer comprising a charge generation layer and a charge transport layer, the charge generation layer contains the above phthalocyanine composition of the present invention and, if necessary, the charge generation substance (an organic pigment which generates a charge), and the charge transport layer contains the above charge transport substance.

To the charge generation layer, the above binder and the above additive may be added. The amount of the binder to be formulated is preferably 500 parts by weight or less based on the total amount of the above phthalocyanine composition of the present invention and the charge generation substance being 100 parts by weight. The amount of the additive to be formulated is preferably 5 parts by weight or less based on the total amount of the above phthalocyanine composition of the present invention and the charge generation substance being 100 parts by weight.

To the charge transport layer, the above binder may be added. The amount of the binder to be formulated is preferably 500 parts by weight or less based on 100 parts by weight of the charge transport substance. When the charge transport substance is a low molecular weight compound, the amount of the binder to be formulated is preferably 50 parts by weight or more based on 100 parts by weight of the charge transport substance.

The thickness of the photoconductive layer in the electrophotographic photoreceptor of the present invention is preferably 5 to 50 $\mu$m.

When a composite double-layered structure photoconductive layer comprising a charge generation layer and a charge transport layer is used, the thickness of the charge generation layer is preferably 0.01 to 1 $\mu$m, more preferably 0.1 to 0.5 $\mu$m. If the thickness of the charge generation layer is less than 0.01 $\mu$m, it tends to be difficult to form the charge generation layer uniformly, while if it exceeds 1 $\mu$m, electrophotographic characteristics tend to be lowered.

When a composite double-layered structure photoconductive layer comprising a charge generation layer and a charge transport layer is used, the thickness of the charge transport layer is preferably 5 to 50 $\mu$m, more preferably 15 to 30 $\mu$m. If the thickness of the charge transport layer is less than 5 $\mu$m, initial potential tends to be lowered, while if it exceeds 50 $\mu$m, sensitivity tends to be lowered.

The coating solution for forming a charge generation layer of the present invention contains the above phthalocyanine composition of the present invention.

The coating solution for forming a charge generation layer of the present invention can be prepared by dispersing or dissolving the above phthalocyanine composition of the present invention, if necessary, the charge generation substance and the above additive such as a binder, a plasticizer, a flowability imparting agent, a pinhole preventing agent, an antioxidant and a UV absorbent, uniformly in a solvent.

The solvent to be used in the coating solution for forming a charge generation layer of the present invention may include, for example, an aromatic solvent (e.g., toluene, xylene and anisole), a ketone type solvent (e.g., cyclohexanone and methylcyclohexanone), a halogenated hydrocarbon type solvent (e.g., methylene chloride and carbon tetrachloride), an alcoholic solvent (e.g., methanol, ethanol, propanol, 1-methoxy-2-propanol, 2-methoxyethanol, 2-ethoxyethanol and 2-butoxyethanol) and an ether type solvent (e.g., tetrahydrofuran, 1,3-dioxolan and 1,4-dioxolan). These solvents may be used singly or in combination of two or more.

The amount of the solvent to be used in the coating solution for forming a charge generation layer of the present invention is preferably 900 to 10,000 parts by weight based on the total amount of the above phthalocyanine composition of the present invention, if necessary, the charge generation substance and the above binder and additive being 100 parts by weight. If the amount to be used is less than 900 parts by weight, it tends to be difficult to form a charge generation layer having a thickness which is less than the upper limit, i.e., 1 $\mu$m of the preferred thickness of the charge generation layer, while if it exceeds 10,000 parts by weight, it tends to be difficult to form a charge generation layer uniformly.

The coating solution for forming a charge generation layer of the present invention can be dispersed or dissolved in a solvent uniformly by using a ball mill, ultrasonic wave, a homogenizer, a homomixer or the like.

In the electrophotographic photoreceptor of the present invention, as a method of forming the photoconductive layer on the photoconductive substrate, there may be mentioned, for example, a method in which the above coating solution for forming a charge generation layer of the present invention is coated on the conductive substrate and dried.

As a coating method for coating the coating solution for forming a charge generation layer on the conductive substrate, there may be mentioned, for example, a spin coating method and a dip coating method.

As the spin coating method, there may be mentioned a method in which spin coating is carried out at a rotation number of 500 to 4,000 rpm by using the coating solution for forming a charge generation layer obtained above. As the dip coating method, there may be mentioned a method in which the conductive substrate is dipped in the coating solution for forming a charge generation layer obtained above.

When both of the charge generation layer and the charge transport layer are to be formed on the substrate, there may be formed by preparing the above coating solution for forming a charge generation layer of the present invention and a coating solution for forming a charge transport layer in which the charge transport substance and, if necessary, a binder are dissolved or dispersed uniformly in the above solvent, and coating the solutions on the conductive substrate in the same manner as described above and drying them one after another. In that case, either of the charge generation layer or the charge transport layer may be an upper layer, or the charge generation layer may be sandwiched between two layers of the charge transport layers.

The electrophotographic photoreceptor according to the present invention may further have a thin adhesive layer or a barrier layer immediately on the conductive substrate, or may have a protective layer on the surface.

EXAMPLES

The present invention is described in detail by referring to Examples.

Example 1

(Preparation of crystal of Phthalocyanine composition (I))

In 2.4 liters of sulfuric acid was dissolved 48 g of a phthalocyanine mixture comprising 36 g of titanylphthalocyanine and 12 g of chloroindium phthalocyanine, and the mixture was stirred at room temperature for 30 minutes. Subsequently, the mixture was dropped to 48 liters of a deionized water cooled with ice water over 50 minutes to be reprecipitated. After the mixture was further stirred for 30 minutes under cooling, the precipitates were separated by filtration.

In the first washing, 4 liters of a deionized water as a washing water was added to the precipitates, and the mixture was stirred. Then, the precipitates were recovered by filtration. The same washing operation was carried out successively four times. The pH and conductivity of the washing water (namely washing water after washing) collected by filtration in the fifth operation were measured (at 23 ° C).

The pH of the washing water was 3.4, and the conductivity was 65.0 $\mu$S/cm.

The pH was measured by using Model PH51 (trade name, manufactured by Yokogawa Denki Co.). Further, the conductivity was measured by Model SC-17A (trade name, manufactured by Shibata Kagaku Kikai Kogyo Co.).

Subsequently, the precipitates were washed with 4 liters of methanol three times and then dried under vacuum by heating at 60° C. for 4 hours, and the resulting precipitates were dried.

When the X-ray diffraction spectrum of the resulting dried product was measured, the product gave a clear peak at 27.2° of Bragg angles (2θ±0.2°) The X-ray diffraction spectrum is shown in FIG. 1.

The X-ray diffraction spectrum was measured by using RADIIIA (trade name, produced by Rigaku Denki Co.).

Figure 2:
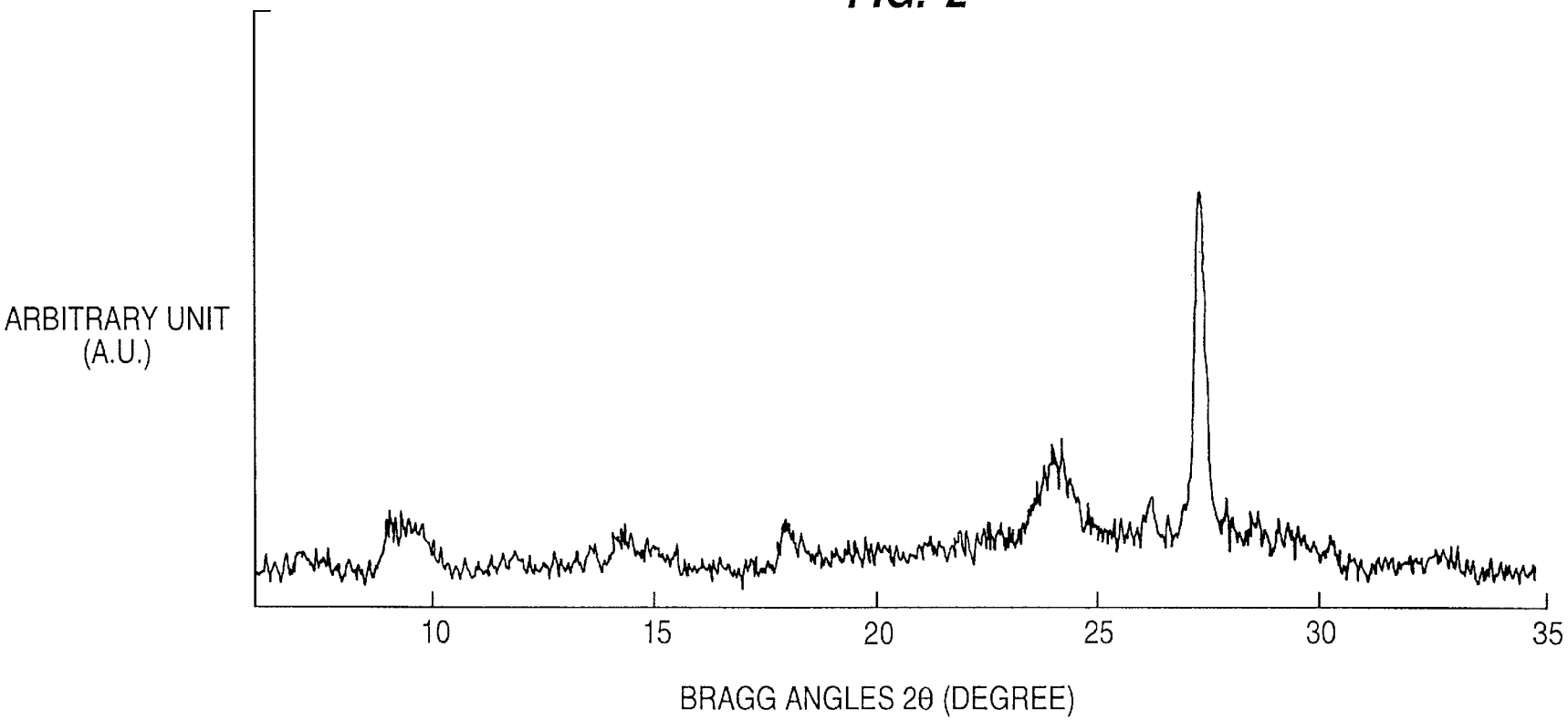
FIG. 2 is an X-ray diffraction spectrum of crystal of Phthalocyanine composition (I) obtained in Example 1.

Next, to 2 g of this dried product were added 140 g of a deionized water, 50 g of toluene and 200 g of zirconia beads having a size of 1 mm in diameter and the mixture was pulverized and stirred under heating at 60° to 70° C. for 5 hours. After cooling, filtration and centrifugalization were carried out. After the solvent was removed, the residue was washed sufficiently with methanol and dried under vacuum by heating at 60° C. for 4 hours to obtain crystal of Phthalocyanine composition (I). When the X-ray diffraction spectrum of the crystal of Phthalocyanine composition (I) obtained was measured, the crystal gave main diffraction peaks at 17.9°, 24.0°, 26.2° and 27.2° of Bragg angles (2θ±0.2°). The X-ray diffraction spectrum of the resulting crystal is shown in FIG. 2.

Example 2

(Preparation of crystal of Phthalocyanine composition (II))

Precipitates were dried in the same manner as in Example 1. To 3 g of this dried product were added 70 g of a deionized water, 25 g of toluene and 100 g of zirconia beads having a size of 1 mm in diameter, and the mixture was pulverized and stirred under heating at 60° to 70° C. for 16 hours. After cooling, filtration and centrifugalization were carried out. After the solvent was removed, the residue was washed sufficiently with methanol and dried under vacuum by heating at 60° C. for 4 hours to obtain crystal of Phthalocyanine composition (II). When the X-ray diffraction spectrum of the crystal of Phthalocyanine composition (II) obtained was measured, the result was the same as that of Example 1.

Example 3

(Preparation of crystal of Phthalocyanine composition (III))

Precipitates were dried in the same manner as in Example 1. To 10 g of this dried product were added 700 g of a deionized water, 250 g of toluene and 1 kg of zirconia beads having a size of 1 mm in diameter, and the mixture was pulverized and stirred under heating at 60° to 70° C. for 5 hours. After cooling, filtration and centrifugalization were carried out. After the solvent was removed, the residue was washed sufficiently with methanol and dried under vacuum by heating at 60° C. for 4 hours to obtain crystal of Phthalocyanine composition (III). When the X-ray diffraction spectrum of the crystal of Phthalocyanine composition (III) obtained was measured, the result was the same as that of Example 1.

Example 4

(Preparation of crystal of Phthalocyanine composition (IV))

Precipitates were dried in the same manner as in Example 1. To 2 g of this dried product were added 20 g of a deionized water, 200 g of toluene and 200 g of zirconia beads having a size of 1 mm in diameter, and the mixture was pulverized and stirred under heating at 60° to 70° C. for 8 hours. After cooling, filtration and centrifugalization were carried out. After the solvent was removed, the residue was washed sufficiently with methanol and dried under vacuum by heating at 60° C. for 4 hours to obtain crystal of Phthalocyanine composition (IV). When the X-ray diffraction spectrum of the crystal of Phthalocyanine composition (Iv) obtained was measured, the result was the same as that of Example 1.

Comparative example 1

(Preparation of crystal of Phthalocyanine composition (i))

Figure 3:
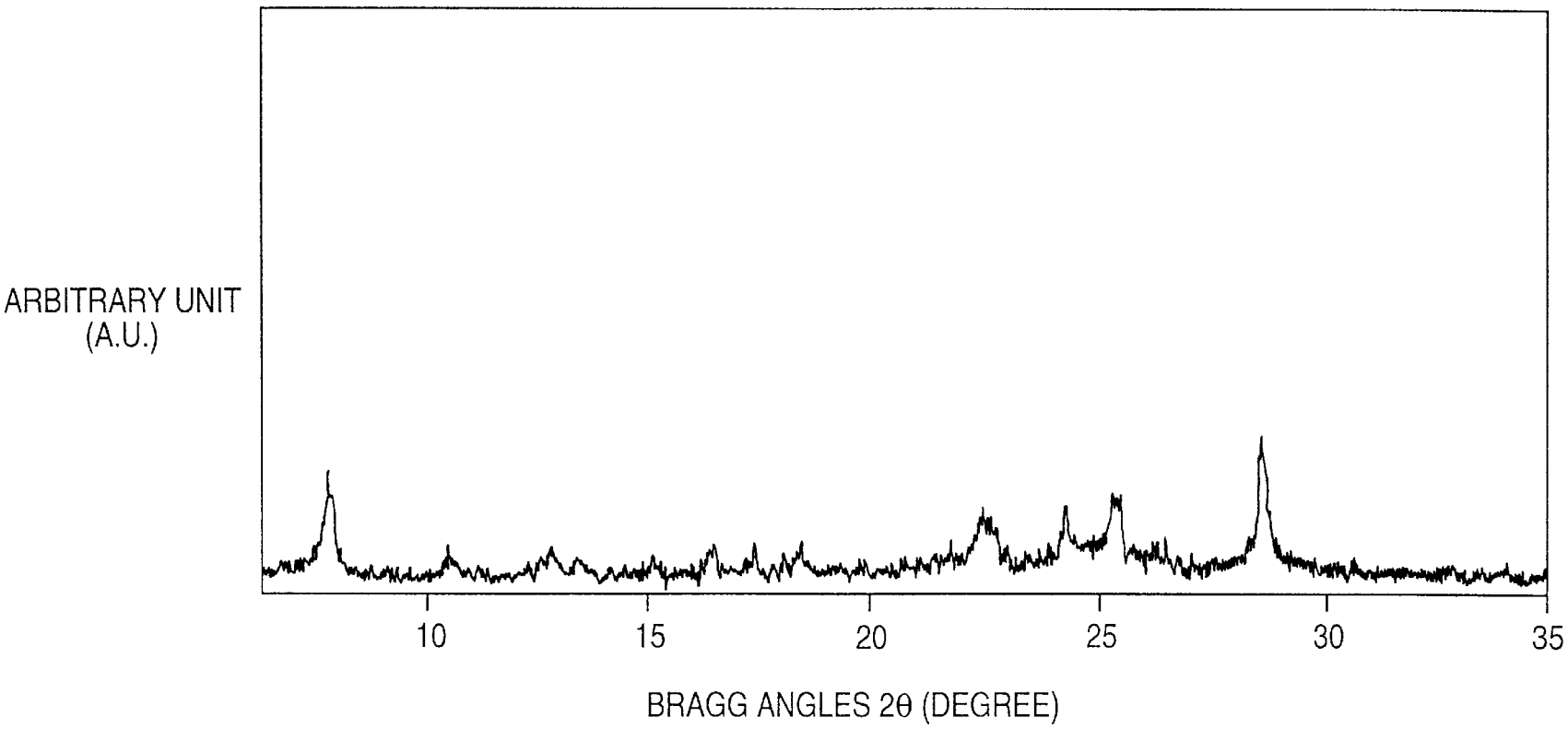
FIG. 3 is an X-ray diffraction spectrum of crystal of Phthalocyanine composition (i) obtained in Comparative example 1.

Precipitates were dried in the same manner as in Example 1. To 10 g of this dried product was added 100 ml of 1-methyl-2-pyrrolidone, and the mixture was stirred under heating at 150° C. for 1 hour. After cooling and filtration, the residue was washed sufficiently with methanol and dried under vacuum by heating at 60° C. for 4 hours to obtain crystal of Phthalocyanine composition (i). When the X-ray diffraction spectrum of the crystal of Phthalocyanine composition (i) obtained was measured, the crystal gave clear diffraction peaks at 7.5°, 22.5°, 24.3°, 25.3° and 28.6° of Bragg angles (2θ±0.2°). The X-ray diffraction spectrum is shown in FIG. 3.

Comparative example 2

(Preparation of crystal of Phthalocyanine composition (ii))

Figure 4:
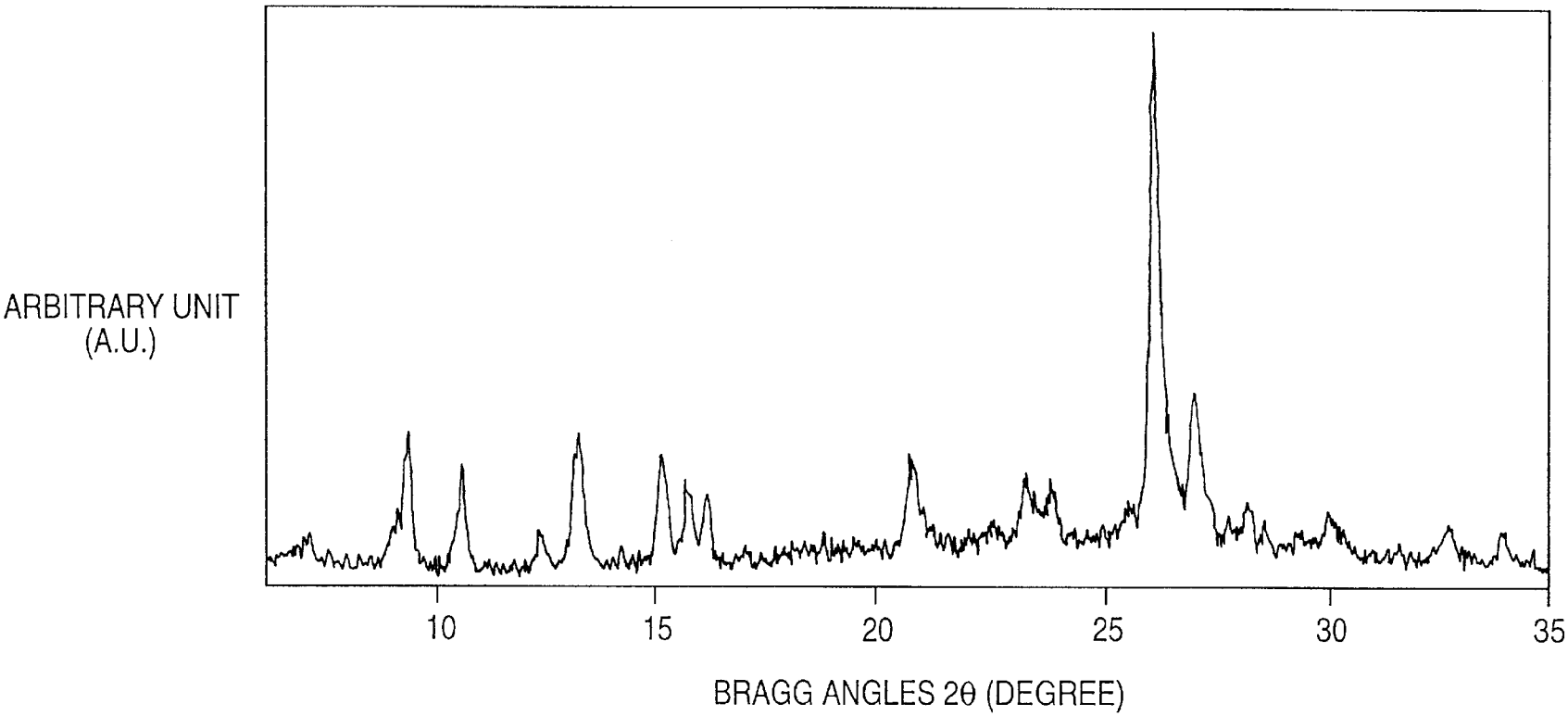
FIG. 4 is an X-ray diffraction spectrum of crystal of Phthalocyanine composition (ii) obtained in Comparative example 2.

Precipitates were dried in the same manner as in Example 1 except for dissolving 60 g of a phthalocyanine mixture comprising 45 g of titanylphthalocyanine and 15 g of chloroindium phthalocyanine in 1.2 liters of sulfuric acid. To 10 g of this dried product was added 100 ml of 1-methyl-2-pyrrolidone, and the mixture was stirred under heating at 150° C. for 1 hour. After cooling and filtration, the residue was washed sufficiently with methanol and dried under vacuum by heating at 60° C. for 4 hours to obtain crystal of Phthalocyanine composition (ii). When the X-ray diffraction spectrum of the crystal of Phthalocyanine composition (ii) obtained was measured, the crystal gave clear diffraction peaks at 9.3°, 13.1°, 15.0° and 26.2° of Bragg angles (2θ±0.2°). The X-ray diffraction spectrum of this crystal is shown in FIG. 4.

Comparative example 3

(Preparation of crystal of Phthalocyanine composition (iii))

Figure 5:
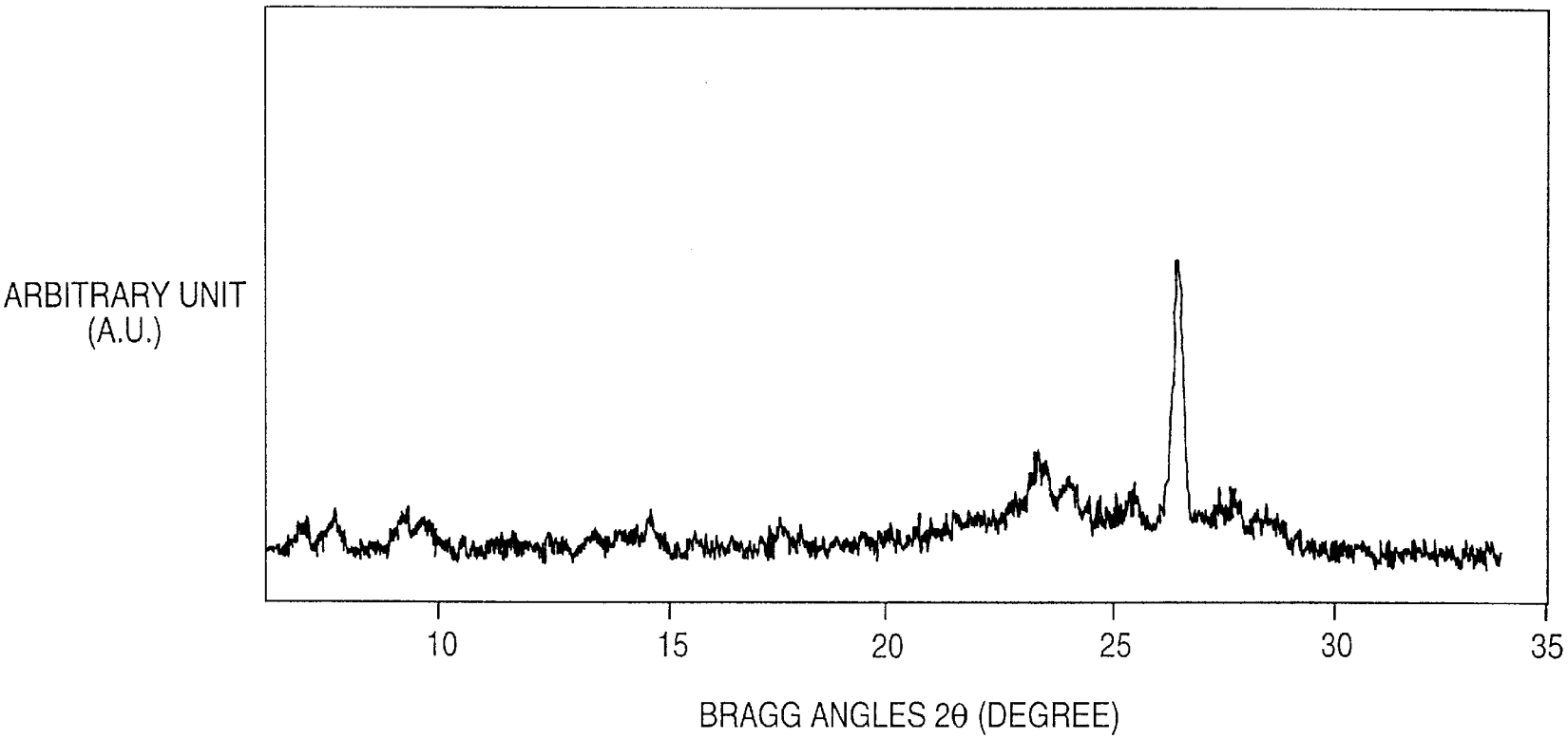
FIG. 5 is an X-ray diffraction spectrum of crystal of Phthalocyanine composition (iii) obtained in Comparative example 3.

Precipitates were dried in the same manner as in Example 1. To 2 g of this dried product were added 140 g of a deionized water and 50 g of toluene, and the mixture was stirred under heating at 60° to 70° C. for 5 hours. After the supernatant was removed by centrifugalization, the residue was washed sufficiently with methanol and dried under vacuum by heating at 60° C. for 4 hours to obtain crystal of Phthalocyanine composition (iii). When the X-ray diffraction spectrum of the crystal of Phthalocyanine composition (iii) obtained was measured, the crystal gave main diffraction peaks at 7.5°, 24.2° and 27.3° of Bragg angles (2θ±0.2°). The X-ray diffraction spectrum of this crystal is shown in FIG. 5.

Comparative example 4

(Preparation of crystal of Phthalocyanine composition (iv))

Precipitates were dried in the same manner as in Example 1. To 2 g of this dried product were added 20 g of a deionized water and 200 g of toluene, and the mixture was stirred under heating at 60° to 70° C. for 8 hours. After the supernatant was removed by centrifugalization, the residue was washed sufficiently with methanol and dried under vacuum by heating at 60° C. for 4 hours to obtain crystal of Phthalocyanine composition (iv). When the X-ray diffraction spectrum of the crystal of Phthalocyanine composition (iv) obtained was measured, the result was the same as that of Comparative example 3.

Comparative example 5

(Preparation of crystal of Phthalocyanine composition (v))

Precipitates were dried in the same manner as in Example 1. To 2 g of this dried product were added 140 g of a deionized water and 50 g of toluene, and the mixture was stirred under heating at 60° to 70° C. for 5 hours while the mixture was dispersed by ultrasonic wave. After cooling, the supernatant was removed by centrifugalization, and then the residue was washed sufficiently with methanol and dried under vacuum by heating at 60° C. for 4 hours to obtain crystal of Phthalocyanine composition (v). When the X-ray diffraction spectrum of the crystal of Phthalocyanine composition (v) obtained was measured, the result was the same as that of Comparative example 3.

Comparative example 6

(Preparation of crystal of Phthalocyanine composition (vi))

Precipitates were dried in the same manner as in Example 1. To 2 g of this dried product were added 140 g of a deionized water, 50 g of toluene and 200 g of glass beads having a size of 1 mm in diameter, and the mixture was pulverized and stirred under heating at 60° to 70° C. for 5 hours. After cooling, filtration was carried out, and the supernatant was removed by centrifugalization. Subsequently, the residue was washed sufficiently with methanol and dried under vacuum by heating at 60° C. for 4 hours to obtain crystal of Phthalocyanine composition (vi). When the X-ray diffraction spectrum of the crystal of Phthalocyanine composition (vi) obtained was measured, the result was the same as that of Comparative example 3.

Example 5

(Preparation of crystal of Phthalocyanine composition (V))

Crystal of Phthalocyanine composition (V) was obtained in the same manner as in Example 1 except for using bromoindium phthalocyanine in place of chloroindium phthalocyanine. When the X-ray diffraction spectrum of the crystal of Phthalocyanine composition (V) obtained was measured, the result was the same as that of Example 1.

Comparative example 7

(Preparation of crystal of Phthalocyanine composition (vii))

Crystal of Phthalocyanine composition (vii) was obtained in the same manner as in Comparative example 1 except for using bromoindium phthalocyanine in place of chloroindium phthalocyanine. When the X-ray diffraction spectrum of the crystal of Phthalocyanine composition (vii) obtained was measured, the result was the same as that of Comparative example 1.

Example 6

(Preparation of crystal of Phthalocyanine composition (VI))

Crystal of Phthalocyanine composition (VI) was obtained in the same manner as in Example 1 except for using chlorogallium phthalocyanine in place of chloroindium phthalocyanine. When the X-ray diffraction spectrum of the crystal of Phthalocyanine composition (VI) obtained was measured, the result was the same as that of Example 1.

Comparative example 8

(Preparation of crystal of Phthalocyanine composition (viii))

Crystal of Phthalocyanine composition (viii) was obtained in the same manner as in Comparative example 1 except for using chlorogallium phthalocyanine in place of chloroindium phthalocyanine. When the X-ray diffraction spectrum of the crystal of Phthalocyanine composition (viii) obtained was measured, the result was the same as that of Comparative example 1.

Example 7

(Preparation of Coating solution (1) for forming a charge generation layer)

1.5 g of the crystal of Phthalocyanine composition (I) obtained in Example 1, 0.9 g of a polyvinyl butyral resin Ethlec BL-S (trade name, produced by Sekisui Kagaku Co.), 0.1 g of a melamine resin ML365W (trade name, produced by Hitachi Chemical Co., Ltd.), 50 g of 2-ethoxyethanol and 50 g of tetrahydrofuran were mixed, and the mixture was dispersed by a ball mill to prepare Coating solution (1) for forming a charge generation layer.

Example 8

(Preparation of Coating solution (2) for forming a charge generation layer) Coating solution (2) for forming a charge generation layer was prepared in the same manner as in Example 7 except for using the crystal of Phthalocyanine composition (II) obtained in Example 2 in place of the crystal of Phthalocyanine composition (I) obtained in Example 1.

Example 9

(Preparation of Coating solution (3) for forming a charge generation layer)

Coating solution (3) for forming a charge generation layer was prepared in the same manner as in Example 7 except for using the crystal of Phthalocyanine composition (III) obtained in Example 3 in place of the crystal of Phthalocyanine composition (I) obtained in Example 1.

Example 10

(Preparation of Coating solution (4) for forming a charge generation layer)

Coating solution (4) for forming a charge generation layer was prepared in the same manner as in Example 7 except for using the crystal of Phthalocyanine composition (IV) obtained in Example 4 in place of the crystal of Phthalocyanine composition (I) obtained in Example 1.

Example 11

(Preparation of Coating solution (5) for forming a charge generation layer)

Coating solution (5) for forming a charge generation layer was prepared in the same manner as in Example 7 except for using the crystal of Phthalocyanine composition (V) obtained in Example 5 in place of the crystal of Phthalocyanine composition (I) obtained in Example 1.

Example 12

(Preparation of Coating solution (6) for forming a charge generation layer)

Coating solution (6) for forming a charge generation layer was prepared in the same manner as in Example 7 except for using the crystal of Phthalocyanine composition (VI) obtained in Example 6 in place of the crystal of Phthalocyanine composition (I) obtained in Example 1.

Comparative example 9

(Preparation of Coating solution (①) for forming a charge generation layer)

Coating solution (①) for forming a charge generation layer was prepared in the same manner as in Example 7 except for using the crystal of Phthalocyanine composition (i) obtained in Comparative example 1 in place of the crystal of Phthalocyanine composition (I) obtained in Example 1.

Comparative example 10

(Preparation of Coating solution (②) for forming a charge generation layer)

Coating solution (②) for forming a charge generation layer was prepared in the same manner as in Example 7 except for using the crystal of Phthalocyanine composition (ii) obtained in Comparative example 2 in place of the crystal of Phthalocyanine composition (I) obtained in Example 1.

Comparative example 11

(Preparation of Coating solution (③) for forming a charge generation layer)

Coating solution (③) for forming a charge generation layer was prepared in the same manner as in Example 7 except for using the crystal of Phthalocyanine composition (iii) obtained in Comparative example 3 in place of the crystal of Phthalocyanine composition (I) obtained in Example 1.

Comparative example 12

(Preparation of Coating solution (④) for forming a charge generation layer)

Coating solution (④) for forming a charge generation layer was prepared in the same manner as in Example 7 except for using the crystal of Phthalocyanine composition (iv) obtained in Comparative example 4 in place of the crystal of Phthalocyanine composition (I) obtained in Example 1.

Comparative example 13

(Preparation of Coating solution (⑤) for forming a charge generation layer)

Coating solution (⑤) for forming a charge generation layer was prepared in the same manner as in Example 7 except for using the crystal of Phthalocyanine composition (v) obtained in Comparative example 5 in place of the crystal of Phthalocyanine composition (I) obtained in Example 1.

Comparative example 14

(Preparation of Coating solution (⑥) for forming a charge generation layer)

Coating solution (⑥) for forming a charge generation layer was prepared in the same manner as in Example 7 except for using the crystal of Phthalocyanine composition (vi) obtained in Comparative example 6 in place of the crystal of Phthalocyanine composition (I) obtained in Example 1.

Comparative example 15

(Preparation of Coating solution (⑦) for forming a charge generation layer)

Coating solution (⑦) for forming a charge generation layer was prepared in the same manner as in Example 7 except for using the crystal of Phthalocyanine composition (vii) obtained in Comparative example 7 in place of the crystal of Phthalocyanine composition (I) obtained in Example 1.

Comparative example 16

(Preparation of Coating solution (⑧) for forming a charge generation layer)

Coating solution (⑧) for forming a charge generation layer was prepared in the same manner as in Example 7 except for using the crystal of Phthalocyanine composition (viii) obtained in Comparative example 8 in place of the crystal of Phthalocyanine composition (I) obtained in Example 1.

Example 13

(Preparation of Electrophotographic photoreceptor (A))

26.6 parts by weight of an alcohol-soluble polyamide resin M1276 (trade name, produced by Nihon Rirusan Co.), 52.3 parts by weight of a melamine resin ML2000 (trade name, produced by Hitachi Chemical Co., Ltd., solid content: 50% by weight) and 2.8 parts by weight of trimellitic anhydride (produced by Wako Junyaku Kogyo Co.) were dissolved in 620 parts by weight of ethanol and 930 parts by weight of 1,1,2-trichloroethane to prepare a coating solution.

The coating solution obtained was coated on an aluminum plate (conductive substrate, 100 mm×100 mm×0.1 mm) by the dip coating method and dried at 140° C. for 30 minutes to form a subbing layer having a thickness of 0.3 μm.

Then, Coating solution (1) for forming a charge generation layer obtained in Example 7 was coated on the above subbing layer of the aluminum substrate by the dip coating method and dried at 120° C. for 10 minutes to form a charge generation layer having a thickness of 0.2 μm.

Then, a coating solution obtained by mixing 15 g of the above charge transport substance No. 1, 15 g of a polycarbonate resin Upilon Z-200 (trade name, produced by Mitsubishi Gas Kagaku Co.), 1 g of 2,6-di-t-butyl-4-methylphenol, 20 g of cyclohexanone and 80 g of tetrahydrofuran was coated on the above charge generation layer of the aluminum substrate by the dip coating method and dried at 100° C. for one hour to form a charge transport layer having a thickness of 20 μm, whereby Electrophotographic photoreceptor (A) was prepared.

The electrophotographic characteristics (sensitivity, residual potential and dark decay rate) of Electrophotographic photoreceptor (A) obtained were measured, and the results are shown in Table 1.

The electrophotographic characteristics were measured by using Cynthia 30HC (trade name, manufactured by Midoriya Denki Co.) and by charging the photoreceptor up to −650 V by a corona charging system and exposing the photoreceptor to monochromatic light at 780 nm for 25 mS.

The above characteristics are defined as described below.

Sensitivity (E½) is an irradiation energy of monochromatic light at 780 nm required for reducing an initial charge potential of −650 V by half at 0.2 second after exposure.

Residual potential (Vr) is a potential remaining on the surface of the photoreceptor at 0.2 second after monochromatic light of 20 mJ/m$^2$ having the same wavelength is exposed.

Dark decay rate ($DDR_t$) is defined as $(V_t/650)\times100$ by using −650 V which is an initial charge potential of the photoreceptor and $V_t$ (−V) which is a surface potential after the photoreceptor after initial charging is left to stand in a dark place for t second(s).

Example 14

(Preparation of Electrophotographic photoreceptor (B))

Electrophotographic photoreceptor (B) was prepared in the same manner as in Example 13 except for using Coating solution (4) for forming a charge generation layer obtained in Example 10 in place of Coating solution (1) for forming a charge generation layer obtained in Example 7.

The electrophotographic characteristics (sensitivity, residual potential and dark decay rate) of Electrophotographic photoreceptor (B) obtained were measured in the same manner as in Example 13, and the results are shown in Table 1.

Comparative example 17

(Preparation of Electrophotographic photoreceptor (a))

Electrophotographic photoreceptor (a) was prepared in the same manner as in Example 13 except for using Coating solution (①) for forming a charge generation layer obtained in Comparative example 9 in place of Coating solution (1) for forming a charge generation layer obtained in Example 7.

The electrophotographic characteristics (sensitivity, residual potential and dark decay rate) of Electrophotographic photoreceptor (a) obtained were measured in the same manner as in Example 13, and the results are shown in Table 1.

Comparative example 18

(Preparation of Electrophotographic photoreceptor (b))

Electrophotographic photoreceptor (b) was prepared in the same manner as in Example 13 except for using Coating solution (②) for forming a charge generation layer obtained in Comparative example 10 in place of Coating solution (1) for forming a charge generation layer obtained in Example 7.

The electrophotographic characteristics (sensitivity, residual potential and dark decay rate) of Electrophotographic photoreceptor (b) obtained were measured in the same manner as in Example 13, and the results are shown in Table 1.

Comparative example 19

(Preparation of Electrophotographic photoreceptor (c))

Electrophotographic photoreceptor (c) was prepared in the same manner as in Example 13 except for using Coating solution (③) for forming a charge generation layer obtained in Comparative example 11 in place of Coating solution (1) for forming a charge generation layer obtained in Example 7.

The electrophotographic characteristics (sensitivity, residual potential and dark decay rate) of Electrophotographic photoreceptor (c) obtained were measured in the same manner as in Example 13, and the results are shown in Table 1.

Comparative example 20

(Preparation of Electrophotographic photoreceptor (d))

Electrophotographic photoreceptor (d) was prepared in the same manner as in Example 13 except for using Coating solution (④) for forming a charge generation layer obtained in Comparative example 12 in place of Coating solution (1) for forming a charge generation layer obtained in Example 7.

The electrophotographic characteristics (sensitivity, residual potential and dark decay rate) of Electrophotographic photoreceptor (d) obtained were measured in the same manner as in Example 13, and the results are shown in Table 1.

TABLE 1

| | Charge generation substance | Charge transport substance | Sensitivity ($E_{1/2}$) ($mJ/m^2$) | Residual potential (Vr 0.2) (−V) | Dark decay ($DDR_1$) (%) | Dark decay ($DDR_5$) (%) |
|---|---|---|---|---|---|---|
| Example 13 | Phthalocyanine composition (I) | No. 1 | 1.1 | 30 | 98.8 | 95.2 |
| Example 14 | Phthalocyanine composition (IV) | No. 1 | 1.1 | 31 | 98.5 | 95.1 |
| Comparative example 17 | Phthalocyanine composition (i) | No. 1 | 2.6 | 44 | 97.3 | 92.6 |
| Comparative example 18 | Phthalocyanine composition (ii) | No. 1 | 1.8 | 48 | 97.0 | 92.2 |
| Comparative example 19 | Phthalocyanine composition (iii) | No. 1 | 1.4 | 31 | 98.3 | 92.3 |
| Comparative example 20 | Phthalocyanine composition (iv) | No. 1 | 1.4 | 34 | 97.2 | 90.6 |

From Table 1, it can be seen that as compared with the results of the characteristics of the electrophotographic photoreceptors (Examples 13 and 14) of the present invention, the electrophotographic photoreceptors of Comparative examples 17 and 18 have poor sensitivity. Also, it can be seen that in Comparative examples 19 and 20, good sensitivity and dark decay rate values are obtained, but the dark decay rates when the electrophotographic photoreceptors after initial charging were left to stand in a dark place for a long period of time are poor.

Example 15

(Preparation of Electrophotographic photoreceptor (C))

Electrophotographic photoreceptor (C) was prepared in the same manner as in Example 13 except for using the charge transport substance No. 2 in place of the charge transport substance No. 1.

The electrophotographic characteristics (sensitivity, residual potential and dark decay rate) of Electrophotographic photoreceptor (C) obtained were measured in the same manner as in Example 13, and the results are shown in Table 2.

Example 16

(Preparation of Electrophotographic photoreceptor (D))

Electrophotographic photoreceptor (D) was prepared in the same manner as in Example 15 except for using Coating solution (2) for forming a charge generation layer obtained in Example 8 in place of Coating solution (1) for forming a charge generation layer obtained in Example 7.

The electrophotographic characteristics (sensitivity, residual potential and dark decay rate) of Electrophotographic photoreceptor (D) obtained were measured in the same manner as in Example 15 and the results are shown in Table 2.

Example 17

(Preparation of Electrophotographic photoreceptor (E))

Electrophotographic photoreceptor (E) was prepared in the same manner as in Example 15 except for using Coating solution (3) for forming a charge generation layer obtained in Example 9 in place of Coating solution (1) for forming a charge generation layer obtained in Example 7.

The electrophotographic characteristics (sensitivity, residual potential and dark decay rate) of Electrophotographic photoreceptor (E) obtained were measured in the same manner as in Example 15, and the results are shown in Table 2.

Comparative example 21

(Preparation of Electrophotographic photoreceptor (e))

Electrophotographic photoreceptor (e) was prepared in the same manner as in Example 15 except for using Coating solution (③) for forming a charge generation layer obtained in Comparative example 11 in place of Coating solution (1) for forming a charge generation layer obtained in Example 7.

The electrophotographic characteristics (sensitivity, residual potential and dark decay rate) of Electrophotographic photoreceptor (e) obtained were measured in the same manner as in Example 15, and the results are shown in Table 2.

Comparative example 22

(Preparation of Electrophotographic photoreceptor (f))

Electrophotographic photoreceptor (f) was prepared in the same manner as in Example 15 except for using Coating solution (⑤) for forming a charge generation layer obtained in Comparative example 13 in place of Coating solution (1) for forming a charge generation layer obtained in Example 7.

The electrophotographic characteristics (sensitivity, residual potential and dark decay rate) of Electrophotographic photoreceptor (f) obtained were measured in the same manner as in Example 15, and the results are shown in Table.2.

Comparative example 23

(Preparation of Electrophotographic photoreceptor (g))

Electrophotographic photoreceptor (g) was prepared in the same manner as in Example 15 except for using Coating solution (⑥) for forming a charge generation layer obtained in Comparative example 14 in place of Coating solution (1) for forming a charge generation layer obtained in Example 7.

The electrophotographic characteristics (sensitivity, residual potential and dark decay rate) of Electrophotographic photoreceptor (g) obtained were measured in the same manner as in Example 15, and the results are shown in Table 2.

Example 18

(Preparation of Electrophotographic photoreceptor (F))

Electrophotographic photoreceptor (F) was prepared in the same manner as in Example 13 except for using Coating solution (5) for forming a charge generation layer obtained in Example 11 in place of Coating solution (1) for forming a charge generation layer obtained in Example 7 and using the charge transport substance No. 3 in place of the charge transport substance No. 1.

The electrophotographic characteristics (sensitivity, residual potential and dark decay rate) of Electrophotographic photoreceptor (F) obtained were measured in the same manner as in Example 13, and the results are shown in Table 2.

Example 19

(Preparation of Electrophotographic photoreceptor (G))

Electrophotographic photoreceptor (G) was prepared in the same manner as in Example 18 except for using Coating solution (6) for forming a charge generation layer obtained in Example 12 in place of Coating solution (5) for forming a charge generation layer obtained in Example 11.

The electrophotographic characteristics (sensitivity, residual potential and dark decay rate) of Electrophotographic photoreceptor (G) obtained were measured in the same manner as in Example 18, and the results are shown in Table 2.

Comparative example 24

(Preparation of Electrophotographic photoreceptor (h))

Electrophotographic photoreceptor (h) was prepared in the same manner as in Example 18 except for using Coating solution (⑦) for forming a charge generation layer obtained in Comparative example 15 in place of Coating solution (5) for forming a charge generation layer obtained in Example 11.

The electrophotographic characteristics (sensitivity, residual potential and dark decay rate) of Electrophotographic photoreceptor (h) obtained were measured in the same manner as in Example 18, and the results are shown in Table 2.

Comparative example 25

(Preparation of Electrophotographic photoreceptor (i))

Electrophotographic photoreceptor (i) was prepared in the same manner as in Example 18 except for using Coating solution (⑧) for forming a charge generation layer obtained in Comparative example 16 in place of Coating solution (5) for forming a charge generation layer obtained in Example 11.

The electrophotographic characteristics (sensitivity, residual potential and dark decay rate) of Electrophotographic photoreceptor (i) obtained were measured in the same manner as in Example 18, and the results are shown in Table 2.

TABLE 2

| | Charge generation substance | Charge transport substance | Sensitivity ($E_{1/2}$) ($mJ/m^2$) | Residual potential (Vr 0.2) (−V) | Dark decay ($DDR_1$) (%) | Dark decay ($DDR_5$) (%) |
|---|---|---|---|---|---|---|
| Example 15 | Phthalocyanine composition (I) | No. 2 | 0.9 | 45 | 98.6 | 95.8 |
| Example 16 | Phthalocyanine composition (II) | No. 2 | 1.1 | 45 | 98.8 | 96.2 |
| Example 17 | Phthalocyanine composition (III) | No. 2 | 1.0 | 40 | 99.1 | 96.8 |
| Comparative example 21 | Phthalocyanine composition (iii) | No. 2 | 1.4 | 60 | 97.2 | 91.6 |
| Comparative | Phthalocyanine composition (v) | No. 2 | 1.5 | 65 | 96.9 | 90.2 |

TABLE 2-continued

| | Charge generation substance | Charge transport substance | Sensitivity ($E_{1/2}$) ($mJ/m^2$) | Residual potential (Vr 0.2) (−V) | Dark decay ($DDR_1$) (%) | Dark decay ($DDR_5$) (%) |
|---|---|---|---|---|---|---|
| example 22 | | | | | | |
| Comparative example 23 | Phthalocyanine composition (vi) | No. 2 | 1.3 | 55 | 97.7 | 91.8 |
| Example 18 | Phthalocyanine composition (V) | No. 3 | 1.2 | 50 | 98.1 | 94.9 |
| Example 19 | Phthalocyanine composition (VI) | No. 3 | 1.2 | 50 | 98.2 | 94.2 |
| Comparative example 24 | Phthalocyanine composition (vii) | No. 3 | 1.6 | 70 | 95.7 | 87.7 |
| Comparative example 25 | Phthalocyanine composition (viii) | No. 3 | 1.6 | 75 | 95.9 | 88.1 |

From Table 2, it can be seen that as compared with the results of the characteristics of the electrophotographic photoreceptors (Examples 15 to 19) of the present invention, in Comparative examples 21 to 25, good sensitivity and dark decay rate values are obtained, but the dark decay rates when the electrophotographic photoreceptors after initial charging were left to stand in a dark place for a long period of time are poor.

Example 20

(Preparation of Electrophotographic photoreceptor (H))

After a charge generation layer was formed in the same manner as in Example 13, Electrophotographic photoreceptor (H) was prepared in the same manner as in Example 13 except for coating a coating solution obtained by mixing 12 g of the above charge transport substance No. 11, 18 g of a polycarbonate resin Upilon Z-200 (trade name, produced by Mitsubishi Gas Kagaku Co.), 25 g of cyclohexanone and 100 g of tetrahydrofuran on the above aluminum substrate by the dip coating method and drying the coating solution at 100° C. for one hour to form a charge transport layer having a thickness of 20 $\mu$m.

The electrophotographic characteristics (sensitivity, residual potential and dark decay rate) of Electrophotographic photoreceptor (H) obtained were measured in the same manner as in Example 13, and the results are shown in Table 3.

Example 21

(Preparation of Electrophotographic photoreceptor (I))

Electrophotographic photoreceptor (I) was prepared in the same manner as in Example 20 except for using Coating solution (3) for forming a charge generation layer obtained in Example 9 in place of Coating solution (1) for forming a charge generation layer obtained in Example 7.

The electrophotographic characteristics (sensitivity, residual potential and dark decay rate) of Electrophotographic photoreceptor (I) obtained were measured in the same manner as in Example 20, and the results are shown in Table 3.

Comparative example 26

(Preparation of Electrophotographic photoreceptor (j))

Electrophotographic photoreceptor (j) was prepared in the same manner as in Example 20 except for using Coating solution (③) for forming a charge generation layer obtained in Comparative example 11 in place of Coating solution (1) for forming a charge generation layer obtained in Example 7.

The electrophotographic characteristics (sensitivity, residual potential and dark decay r ate) of Electrophotographic photoreceptor (j) obtained were measured in the same manner as in Example 20, and the results are shown in Table 3.

Comparative example 27

(Preparation of Electrophotographic photoreceptor (k))

Electrophotographic photoreceptor (k) was prepared in the same manner as in Example 20 except for using Coating solution (⑥) for forming a charge generation layer obtained in Comparative example 14 in place of Coating solution (1) for forming a charge generation layer obtained in Example 7.

The electrophotographic characteristics (sensitivity, residual potential and dark decay rate) of Electrophotographic photoreceptor (k) obtained were measured in the same manner as in Example 20, and the results are shown in Table 3.

TABLE 3

| | Charge generation substance | Charge transport substance | Sensitivity ($E_{1/2}$) ($mJ/m^2$) | Residual potential (Vr 0.2) (−V) | Dark decay ($DDR_1$) (%) | Dark decay ($DDR_5$) (%) |
|---|---|---|---|---|---|---|
| Example 20 | Phthalocyanine composition (I) | No. 11 | 1.2 | 30 | 98.3 | 94.5 |
| Example 21 | Phthalocyanine composition (III) | No. 11 | 1.2 | 25 | 98.4 | 94.7 |
| Comparative example 26 | Phthalocyanine composition (iii) | No. 11 | 1.7 | 25 | 96.2 | 86.5 |
| Comparative example 27 | Phthalocyanine composition (vi) | No. 11 | 1.6 | 30 | 95.8 | 86.8 |

From Table 3, it can be seen that as compared with the results of the characteristics of the electrophotographic photoreceptors (Examples 20 and 21) of the present invention, the electrophotographic photoreceptors of Comparative examples 26 and 27 have a poor dark decay rate.

Examples 22 and 23 and Comparative examples 28 and 29

For the purpose of examining change in characteristics (charging characteristics, a dark decay rate and residual potential) when the electrophotographic photoreceptors prepared in Examples 15 and 20 and Comparative examples 21 and 26 were used repeatedly, the following evaluation was carried out.

Change in characteristics at the time of repeated use was examined by using an electrophotographic characteristic-evaluating apparatus Cynthia 99HC (trade name, manufactured by Gentec Co.), defining "charging—measurement of a dark decay rate—elimination of electricity (erasing a surface potential)—charging—exposure (measurement of residual potential)—elimination of electricity (erasing a surface potential)" as one cycle and repeating this cycle, and the evaluation results are shown in Table 4 and Table 5.

Specifically, a corona voltage of −5 kV was applied to the photoreceptor to charge the photoreceptor up to charge potential ($V_0$), and from surface potential ($V_1$) after the photoreceptor was left to stand in a dark place for 1 second, a dark decay rate ($DDR_1=(V_1/V_0)\times100$) was determined.

Then, after elimination of electricity was carried out, a corona voltage of −5 kV was applied again to the photoreceptor to be charged, the photoreceptor was exposed to monochromatic light (20 mJ/m$^2$) at 780 nm, and residual potential (Vr) remaining on the surface of the photoreceptor at 0.2 second after exposure was measured.

Evaluation of image quality was carried out by fog, black dots, white dots and image density at the time of black solid printing, by using an image quality-evaluating apparatus (negatively charged, a reversal development system) and setting surface potential to −700 V and bias potential to −600 V. The black dots and white dots were judged visually with naked eyes. The fog and image density of black solid were evaluated by using a Macbeth reflection densitometer (produced by a division of Kollmergen Corporation).

TABLE 4

| | Charge generation substance | Charge transport substance | Characteristics | Number of cycle 1 | 1000 | 5000 | 10000 |
|---|---|---|---|---|---|---|---|
| Example 22 | Phthalocyanine composition (I) | No. 2 | $V_0$ (−V) | 655 | 650 | 645 | 630 |
| | | | $DDR_1$ (%) | 98.6 | 98.2 | 97.8 | 96.5 |
| | | | $V_r$ (−V) | 45 | 45 | 40 | 35 |
| | | | Black dots | Absent | Absent | Absent | Absent |
| | | | White dots | Absent | Absent | Absent | Absent |
| | | | Fog density | 0.08 | 0.08 | 0.08 | 0.09 |
| | | | Black solid density | 1.47 | 1.48 | 1.47 | 1.47 |
| Example 23 | Phthalocyanine composition (I) | No. 11 | $V_0$ (−V) | 655 | 645 | 635 | 625 |
| | | | $DDR_1$ (%) | 98.3 | 97.9 | 97.2 | 95.1 |
| | | | $V_r$ (−V) | 30 | 35 | 40 | 45 |
| | | | Black dots | Absent | Absent | Absent | Absent |
| | | | White dots | Absent | Absent | Absent | Absent |
| | | | Fog density | 0.09 | 0.10 | 0.10 | 0.10 |
| | | | Black solid density | 1.48 | 1.49 | 1.48 | 1.49 |

TABLE 5

| | Charge generation substance | Charge transport substance | Characteristics | Number of cycle 1 | 1000 | 5000 | 10000 |
|---|---|---|---|---|---|---|---|
| Comparative example 28 | Phthalocyanine composition (iii) | No. 2 | $V_0$ (−V) | 652 | 635 | 615 | 585 |
| | | | $DDR_1$ (%) | 97.2 | 94.0 | 91.8 | 88.9 |
| | | | $V_r$ (−V) | 60 | 45 | 40 | 35 |
| | | | Black dots | Absent | Absent | Present | Present |
| | | | White dots | Present | Present | Present | Present |
| | | | Fog density | 0.09 | 0.11 | 0.15 | 0.25 |
| | | | Black solid density | 1.48 | 1.45 | 1.44 | 1.41 |
| Comparative example 29 | Phthalocyanine composition (iii) | No. 11 | $V_0$ (−V) | 645 | 610 | 580 | 540 |
| | | | $DDR_1$ (%) | 96.2 | 92.8 | 88.6 | 82.3 |
| | | | $V_r$ (−V) | 25 | 35 | 35 | 45 |
| | | | Black dots | Absent | Present | Present | Present |
| | | | White dots | Present | Present | Present | Present |
| | | | Fog density | 0.09 | 0.15 | 0.20 | 0.30 |
| | | | Black solid density | 1.46 | 1.41 | 1.38 | 1.32 |

From Table 4 and Table 5, it can be seen that the electrophotographic photoreceptor (Example 22) of the present invention has high sensitivity and a high dark decay rate, change thereof in characteristics such as charge potential and a dark decay rate at the time of repeated use is small and it has electrophotographic characteristics which are excellent in stability as compared with the electrophotographic photoreceptor of Comparative example 28, and it exhibits good image characteristics at the time of repeated use.

Also, from Table 4 and Table 5, it can be seen that the electrophotographic photoreceptor (Example 23) of the present invention has high sensitivity and low residual potential, change thereof in characteristics such as charge potential and a dark decay rate at the time of repeated use is small and it has electrophotographic characteristics which are excellent in stability as compared with the electrophotographic photoreceptor of Comparative example 29, and it exhibits good image characteristics at the time of repeated use.

The phthalocyanine composition according to claim 1 is suitable as a charge generating material of an electrophotographic photoreceptor which has high sensitivity and is free from deterioration of characteristics at the time of repeated use.

By the process for preparing a phthalocyanine composition according to claim 6, a phthalocyanine composition which is suitable as a charge generating material of an electrophotographic photoreceptor which has high sensitivity and is free from deterioration of characteristics at the time of repeated use can be prepared.

The electrophotographic photoreceptor according to claim 12 has high sensitivity and is free from deterioration of characteristics at the time of repeated use.

The electrophotographic photoreceptor according to claim 13 has high sensitivity and a high dark decay rate, and is free from deterioration of characteristics and exhibits good image characteristics at the time of repeated use.

The electrophotographic photoreceptor according to claim 16 has high sensitivity and low residual potential, and is free from deterioration of characteristics and exhibits good image characteristics at the time of repeated use.

The coating solution for forming a charge generation layer according to claim 19 is suitable for forming a charge generation layer of an electrophotographic photoreceptor which has high sensitivity and is free from deterioration of characteristics at the time of repeated use.

It will be recognized that the term "clear diffraction peak" as used in the present application has reference to those peaks observed among the X-ray diffraction spectra which are sharp peaks and which are main peaks of the X-ray diffraction spectra.

We claim:

1. An electrophotographic photoreceptor having a photoconductive layer containing an organic photoconductive substance on a conductive substrate, in which the organic photoconductive substance is a phthalocyanine composition having clear diffraction peaks at 17.9°, 24.0°, 26.2° and 27.2° of Bragg angles (2θ±0.2°) in an X-ray diffraction spectrum with Cu Kα.

2. A double-layered structure electrophotographic photoreceptor having (A) a charge generation layer containing a phthalocyanine composition having clear diffraction peaks at 17.9°, 24.0°, 26.2° and 27.2° of Bragg angles (2θ±0.2°) in an X-ray diffraction spectrum with Cu Kα, as a charge generation substance, and (B) a charge transport layer containing a benzidine compound represented by the formula (I):

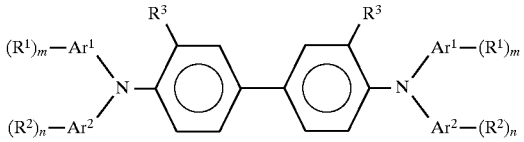

(I)

wherein $R^1$ and $R^2$ each independently represent a hydrogen atom, a halogen atom, an alkyl group, an alkoxy group, an aryl group, a fluoroalkyl group or a fluoroalkoxy group, two $R^3$s each independently represent a hydrogen atom or an alkyl group, $Ar^1$ and $Ar^2$ each independently represent an aryl group, and m and n each independently represent an integer 0 to 5, as a charge transport substance.

3. The photoreceptor according to claim 3, wherein said benzidine compound is at least one selected from the group consisting of N,N,N',N'-tetraphenylbenzidine, N,N'-diphenyl-N,N'-bis(3-methylphenyl)-benzidine (No. 7), N,N,N',N'-tetrakis(3-methylphenyl)-benzidine (No. 8), N,N,N',N'-tetrakis(4-methylphenyl)-benzidine, N,N'-diphenyl-N,N'-bis(4-methoxyphenyl)-benzidine (No. 9), N,N'-diphenyl-N,N'-bis(4-(2,2,2-trifluoroethoxy)phenyl)-benzidine (No. 2), N,N'-bis(3-methylphenyl)-N,N'-bis(4-(2,2,2-trifluoroethoxy)phenyl)-benzidine (No. 1), N,N'-bis(4-methylphenyl)-N,N'-bis(4-(2,2,2-trifluoroethoxy)-phenyl)-benzidine (No. 3), N,N'-bis(4-methylphenyl)-N,N'-bis(3-trifluoromethylphenyl)-benzidine (No. 4), N,N'-bis(3-methylphenyl)-N,N'-bis(3-trifluoromethylphenyl)-benzidine (No. 5), N,N'-diphenyl-N,N'-bis(3-trifluoromethylphenyl)-benzidine (No. 6) and N,N,N',N'-tetrakis(4-methylphenyl)-3,3'-dimethyl-benzidine (No. 10).

4. The photoreceptor according to claim 2, wherein said benzidine compound is N,N'-diphenyl-N,N'-bis(4-(2,2,2-trifluoroethoxy)phenyl)-benzidine (No. 2) or N,N'-bis(3-methylphenyl)-N,N'-bis(4-(2,2,2-trifluoroethoxy)phenyl)-benzidine (No. 1).

5. A double-layered structure electrophotographic photoreceptor having (A) a charge generation layer containing a phthalocyanine composition having clear diffraction peaks at 17.9°, 24.0°, 26.2° and 27.2° of Bragg angles (2θ±0.2°) in an X-ray diffraction spectrum with Cu Kα, as a charge generation substance, and (C) a charge transport layer containing a butadiene compound represented by the formula (II):

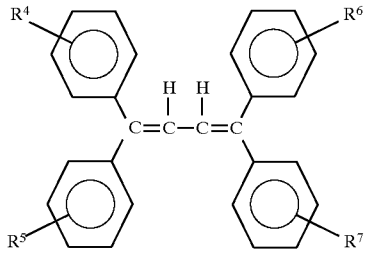

(II)

wherein $R^4$, $R^5$, $R^6$ and $R^7$ each independently represent a hydrogen atom, a halogen atom, an alkyl group, an alkoxy group, a di-lower alkylamino group, a diarylamino group or a diaralkylamino group, as a charge transport substance.

6. The photoreceptor according to claim 5, wherein said butadiene compound is at least one selected from the group consisting of 1,1-bis(4-diethylaminophenyl)-4,4-diphenyl- 1,3-butadiene (No. 11), 1,1-bis(4-methoxyphenyl)-4,4-diphenyl-1,3-butadiene (No. 12), 1,4-bis(4-diethylaminophenyl)-1,4-diphenyl-1,3-butadiene (No. 13), 1,1-bis(4-diethylaminophenyl)-4-(4-chlorophenyl)-4-phenyl-1,3-butadiene (No. 14), 1-(4-diethylaminophenyl)-1-(4-diphenyl-aminophenyl)-4,4-diphenyl-1,3-butadiene (No. 15) and 1-(4-dibenzylaminophenyl)-1-(4-diethylaminophenyl)-4,4-diphenyl-1,3-butadiene (No. 16).

7. The photoreceptor according to claim 5, wherein said butadiene compound is 1,1-bis(4-diethylaminophenyl)-4,4-diphenyl-1,3-butadiene (No. 11).

8. Electrophotographic photoreceptor according to claim 1, wherein said electrophotographic photoreceptor has a sensitivity of from 0.9 to 1.2 $mJ/m^2$.

9. Double-layered structure electrophotographic photoreceptor according to claim 2, wherein said electrophotographic photoreceptor has a sensitivity of from 0.9 to 1.2 $mJ/m^2$.

10. Double-layered structure electrophotographic photoreceptor according to claim 5, wherein said electrophotographic photoreceptor has a sensitivity of from 0.9 to 1.2 $mJ/m^2$.

11. Electrophotographic photoreceptor according to claim 1, wherein said phthalocyanine composition is made by a process comprising the steps of mixing in water by an acid pasting method, a titanylphthalocyanine composition with a halogenated metal phthalocyanine in which a central metal is trivalent, to obtain precipitates and treating said precipitates in a mixed solvent of an aromatic solvent and water.

12. Electrophotographic photoreceptor according to claim 11, wherein said halogenated metal phthalocyanine in which a central metal is trivalent includes a trivalent metal selected from the group consisting of In, Ga and Al and a halogen selected from the group consisting of Cl and Br.

13. Electrophotographic photoreceptor according to claim 1, wherein said phthalocyanine composition is made by mixing 20–95 parts by weight of said titanylphthalocyanine composition, based on a combined total amount of said titanylphthalocyanine composition and said halogenated metal phthalocyanine in which a central metal is trivalent, of 100 parts by weight.

* * * * *